US008546678B1

(12) United States Patent
Stevens

(10) Patent No.: US 8,546,678 B1
(45) Date of Patent: Oct. 1, 2013

(54) COMPACT ELECTRONIC TIMPANI

(76) Inventor: Scott Stevens, Ridgewood, NJ (US)

( * ) Notice: Subject to any disclaimer, the term of this patent is extended or adjusted under 35 U.S.C. 154(b) by 0 days.

(21) Appl. No.: 13/530,538

(22) Filed: Jun. 22, 2012

(51) Int. Cl.
*G10H 1/32* (2006.01)
*G10H 3/00* (2006.01)
*G10G 7/02* (2006.01)

(52) U.S. Cl.
USPC ..... 84/743; 84/419; 84/454

(58) Field of Classification Search
USPC ..... 84/723, 743, 419, 454
See application file for complete search history.

(56) References Cited

U.S. PATENT DOCUMENTS 4,023,462 A * 5/1977 Denov et al. ..... 84/454
4,168,646 A * 9/1979 May ..... 84/723
4,453,448 A * 6/1984 Miesak ..... 84/454
4,741,242 A * 5/1988 Aronstein ..... 84/454
7,888,568 B2 * 2/2011 Kashioka ..... 84/41
8,063,296 B2 * 11/2011 Copeland et al. ..... 84/645
8,198,526 B2 * 6/2012 Izen et al. ..... 84/743

* cited by examiner

*Primary Examiner* — Jeffrey Donels
(74) *Attorney, Agent, or Firm* — Grossman Tucker Perreault & Pfleger, PLLC

(57) ABSTRACT

A compact electronic timpani configured to provide substantially the same or better performance characteristics as a conventional full-size acoustic timpani while being substantially smaller in size. A compact electronic timpani consistent with the present disclosure provides a musician with a similar playing experience as that of conventional full-size acoustic timpani or set of timpani. The compact electronic timpani may allow a performer to perform conventional timpani playing techniques and experience substantially the same acoustical properties, physical sensations and tone production as the performer would encounter when playing a full-size acoustic timpani without the limitations commonly associated with size and/or cost of a full-size acoustic timpani.

20 Claims, 19 Drawing Sheets

COMPACT ELECTRONIC TIMPANI

CROSS-REFERENCE TO RELATED APPLICATIONS

N/A

FIELD

The present disclosure relates generally to musical instruments, and, more particularly, to a compact electronic timpani.

BACKGROUND

Timpani, also known as kettledrums, are large musical instruments in the percussion family. Many musical pieces may be written to include the timpani because of the distinctive sound that the timpani provides. However, the conventional acoustic timpani may have limitations. In particular, a conventional acoustic timpani may be somewhat limited in mobility. For example, due to the relatively large size, the timpani may be bulky and difficult to transport. In addition, due to the large size, a relatively large amount of space is needed in order to accommodate a full set of timpani. Additionally, a set of conventional acoustic timpani may be expensive and may be unaffordable for many musicians to own.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

Figure 1:
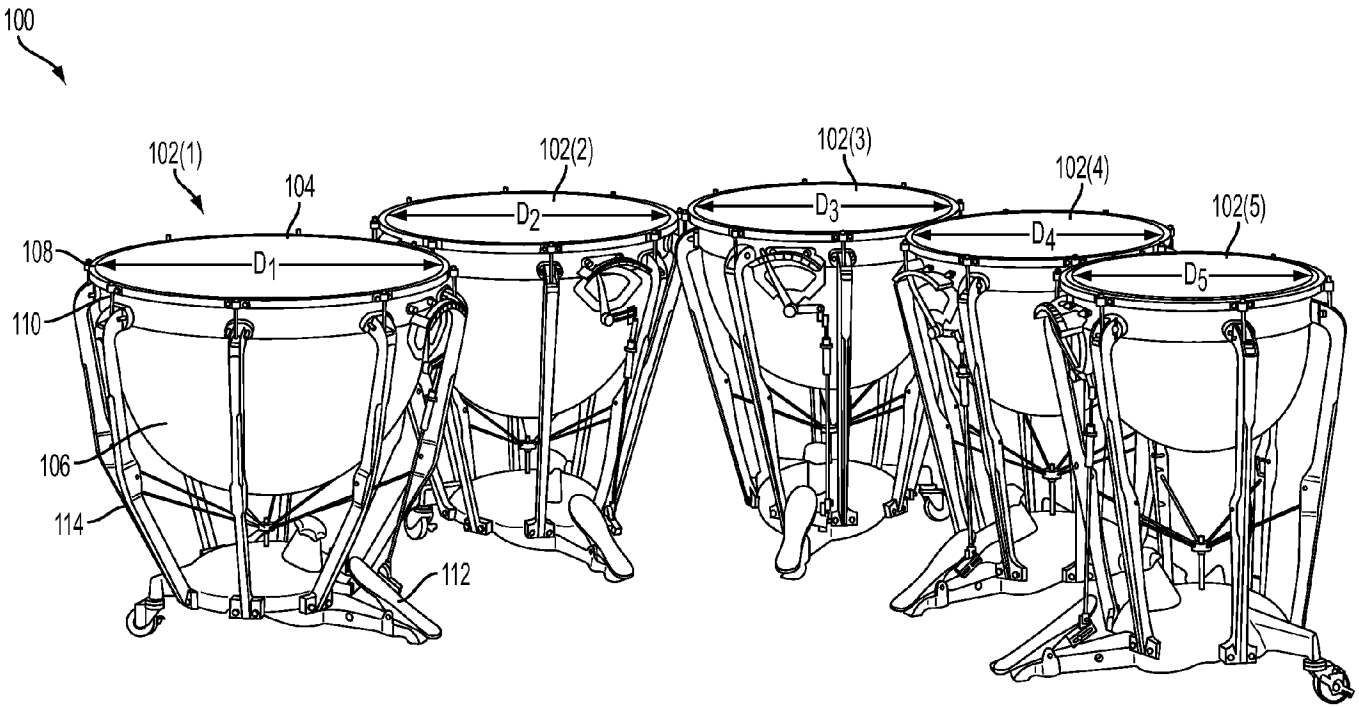
FIG. 1 is a perspective view of an exemplary set of timpani.

Timpani, also known as kettledrums, are large musical instruments in the percussion family. Referring to FIG. 1, a set of acoustic timpani is generally illustrated. As shown, the set 100 may include one or more timpani, e.g. 102(1) to 102(5). Each timpani (hereinafter referred to as "timpani 102") may include a membrane, or head 104, stretched across an opening of a bowl 106 typically made of copper, or other material, such as aluminum or fiberglass. The head 104 may be affixed to a hoop 108 coupled to the bowl 106. As shown, the hoop 108 may be coupled to the bowl 106 by way of one or more tension screws 110, also known as tension rods, placed along the circumference of the bowl 106. The timpani 102 may further include a pedal 112 configured to adjust the tension of the head 104 via the tension screws 110, and thereby affect the tone of the timpani 102 (described in greater detail herein). The timpani 102 may further include a frame 114 configured to support the bowl 106 and generally all other components of the timpani 102.

The timpani 102 is generally played by striking a portion of the head 104 with a specialized drum stick, referred to as a timpani stick or mallet. Timpani are generally considered a type of membranophone in that the timpani 102 produces sound by way of the head 104 (membrane) vibrating in response to a player striking the head 104. When playing, a timpanist (musician who plays timpani) may generally strike a specific portion of the head 104 (a portion near the edge of the bowl 106) to produce the round, resonant sound commonly associated with timpani. A trained timpanist may utilize a variety of playing techniques to produce subtle timbral differences and alter the tone quality of the timpani 102 without switching sticks or adjusting the tuning of the timpani 102. For example, by playing closer to the edge of the head 104, the sound may become thinner and a more staccato sound can be produced by changing the velocity of the stroke or playing closer to the center of the head 104.

As previously described, a timpanist may use the pedal 112 to adjust the tension of the head 104. The tension of the head 104 affects the pitch of the timpani 102. An increase of tension in the head 104 results in a higher pitch, and, conversely, lower tension in the head 104 results in a lower pitch. A timpanist may use the pedal 112 to tune and change the pitch of the timpani 102, wherein movement of the pedal 112 increases or decreases tension of the head 104. Depending on the musical piece, a timpanist may use the pedal 112 to alter the pitch in midst of playing the timpani 102, a method called glissando.

The shape of the bowl 106 may also contribute to the tone quality of the timpani 102. For example, hemispheric bowls may produce brighter tones while parabolic bowls produce darker tones. The size of the bowl 106 may also affect the timbre of the timpani 102. More specifically, the musical range of a timpani is generally determined by the size of the timpani as well as the tightness of the head of the timpani. As shown, the set 100 includes five timpani, each timpani 102(1) to 102(5) having an associated diameter $D_1$ to $D_5$, respectively, wherein each diameter provides an associated pitch range. It should be noted that, although illustrated with five timpani, a set of timpani may include more or less, dependent upon the required or desired pitch range of a particular musical composition. The standard sizes of timpani heads range from about 32 inches in diameter to 20 inches in diameter. For a typical set of five timpani, such as the set 100 of FIG. 1, timpani 102(1) has a diameter $D_1$ of about 32 inches, timpani 102(2) has a diameter $D_2$ of about 29 inches, timpani 102(3) has a diameter $D_3$ of about 26 inches, timpani 102(4) has a diameter $D_4$ of about 23 inches, and timpani 102(5) has a diameter $D_5$ of about 20 inches. Each timpani 102(1) to 102(5) provides an associated pitch range based on the associated size. In particular, timpani 102(1) provides a pitch range of D2 to A2, timpani 102(2) provides F2 to C3, timpani 102(3) provides A2 to E3, timpani 102(4) provides D3 to A3, and timpani 102(5) provides F3 to C4 (note the pitch range of each timpani is approximate).

The present disclosure is generally directed to a compact electronic timpani configured to provide substantially the same or better performance characteristics as a conventional full-size acoustic timpani while being substantially smaller in size. The electronic timpani may further be configured to provide a performer with a similar playing experience as that of conventional acoustic timpani. In particular, an electronic timpani consistent with the present disclosure may allow a performer to perform conventional timpani playing techniques and experience substantially the same acoustical properties, physical sensations and tone production as the performer would encounter when playing an acoustic timpani. Accordingly, a compact electronic timpani consistent with the present disclosure may provide substantially the same or better performance characteristics of an acoustic timpani without the limitations commonly associated with size and/or cost of an acoustic timpani.

Figure 2:
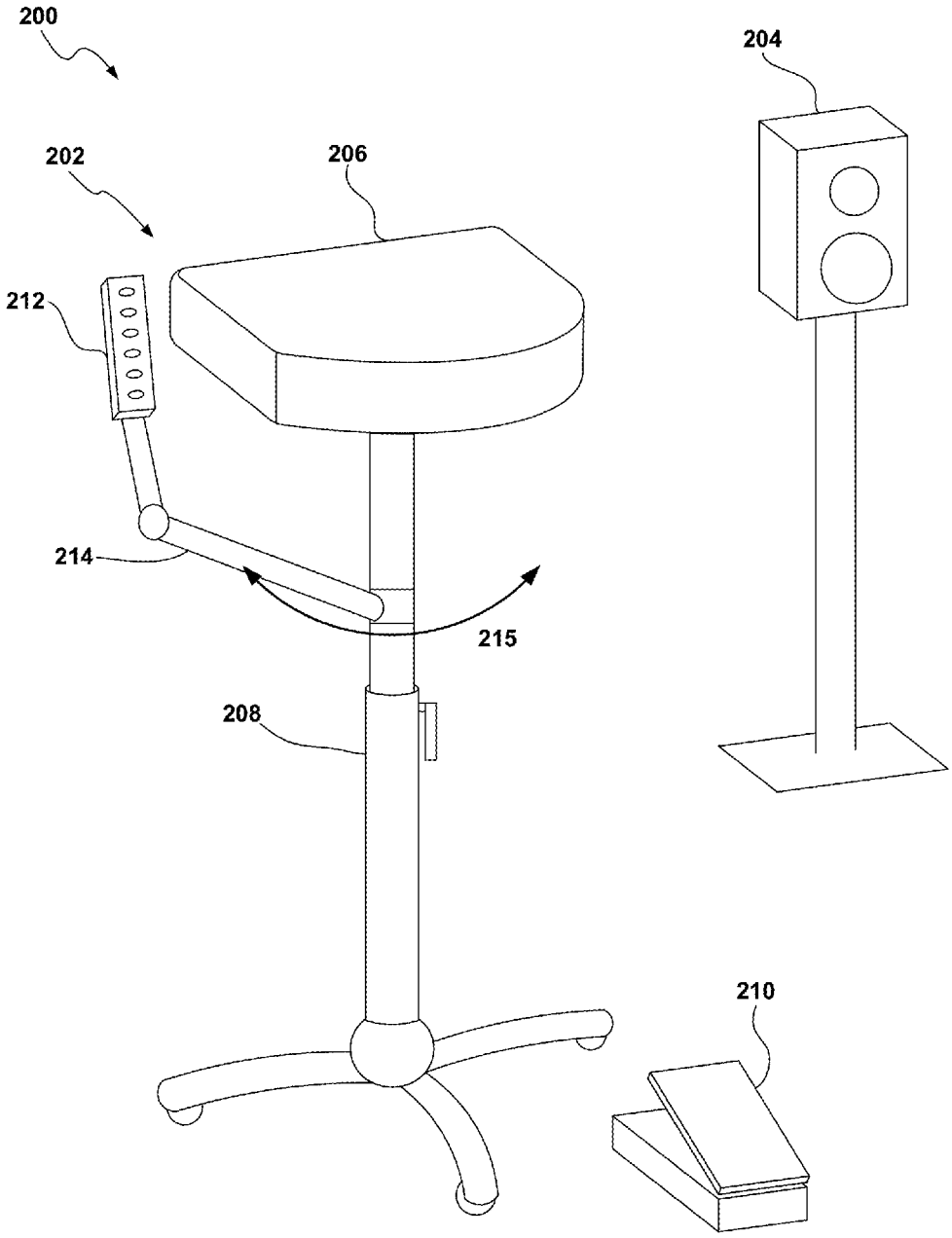
FIG. 2 is a perspective view of a system including a compact electronic timpani assembly consistent with the present disclosure.

FIG. 2 is a perspective view of a system including an electronic timpani assembly consistent with the present disclosure. Generally, the system 200 may include an electronic timpani assembly 202 and an audio output device 204, such as a speaker or headphones, configured to reproduce sound signals received from the timpani assembly 202 into audio content. In the illustrated embodiment, the electronic timpani assembly 202 may include a pad assembly 206, a portion of which is configured to provide a striking surface upon which a musician may perform conventional timpani playing techniques. The pad assembly 206 may further be configured to produce a sound signal corresponding to a musical tone based on varying strikes to the striking surface, as will be described in greater detail herein.

The electronic timpani assembly 202 may further include a stand assembly 208 configured to provide support to the pad assembly 206. The electronic timpani assembly 202 may further include a tuning pedal 210 configured to adjust the pitch of a musical tone and adjust the tautness striking surface of the pad assembly 206 to correspond to any pitch adjustments. The electronic timpani assembly 202 may further include a tuning gauge 212 configured to communicate with the tuning pedal 210 and indicate to the musician the selected pitch. The tuning gauge 212 may be coupled to the stand assembly 208 by way of a support bracket 214. The bracket 214 may be configured to rotate about the stand assembly 208, as indicated by arrows 215, thereby providing flexibility for adjustment and placement of the tuning gauge 212, additional pad and stand assemblies, etc.

Figure 3:
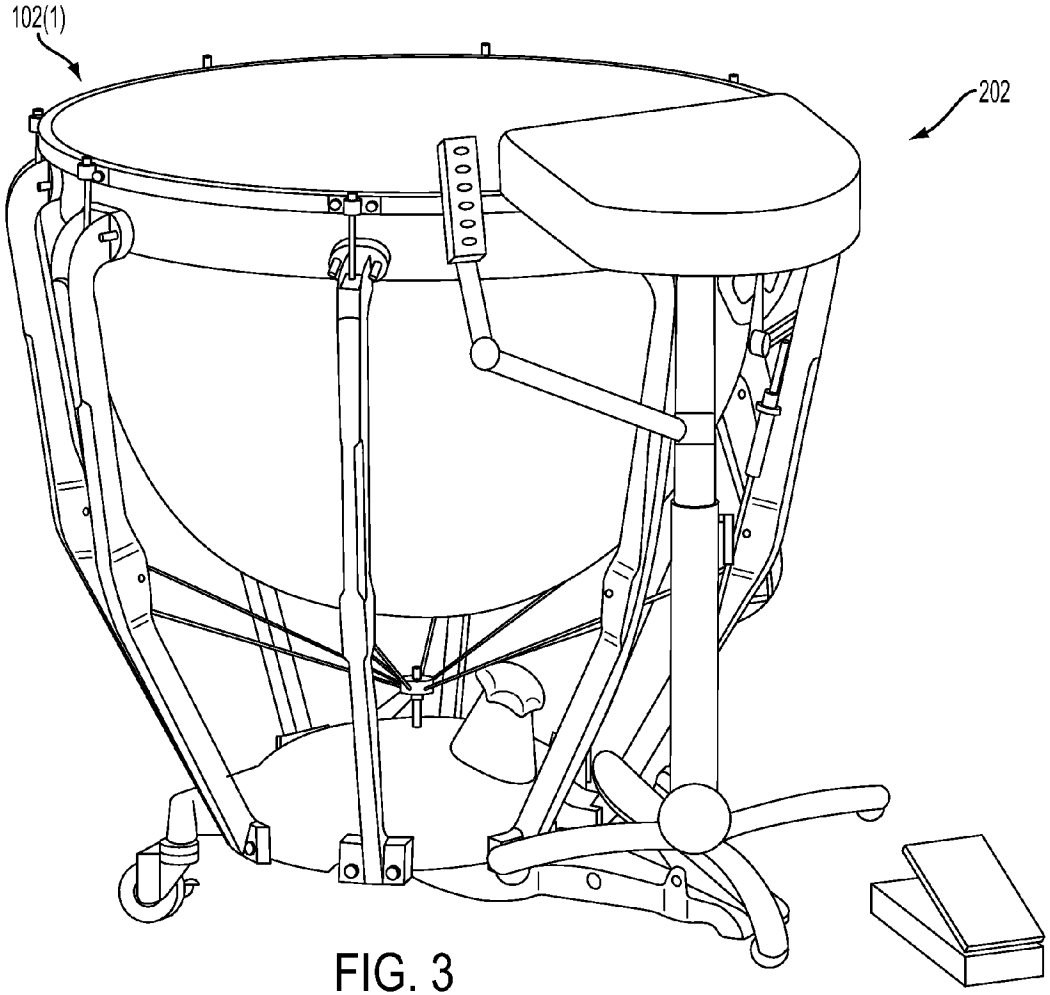
FIG. 3 is a perspective view of an exemplary timpani and a compact electronic timpani assembly consistent with the present disclosure illustrating the size of each in relation to one another.

FIG. 3 is a perspective view of an exemplary timpani 102(1) and an electronic timpani assembly 202 consistent with the present disclosure illustrating the size of each in relation to one another. As shown, the timpani assembly 202 has a relatively compact design and is substantially smaller than the traditional acoustic timpani 102(1).

Figure 4:
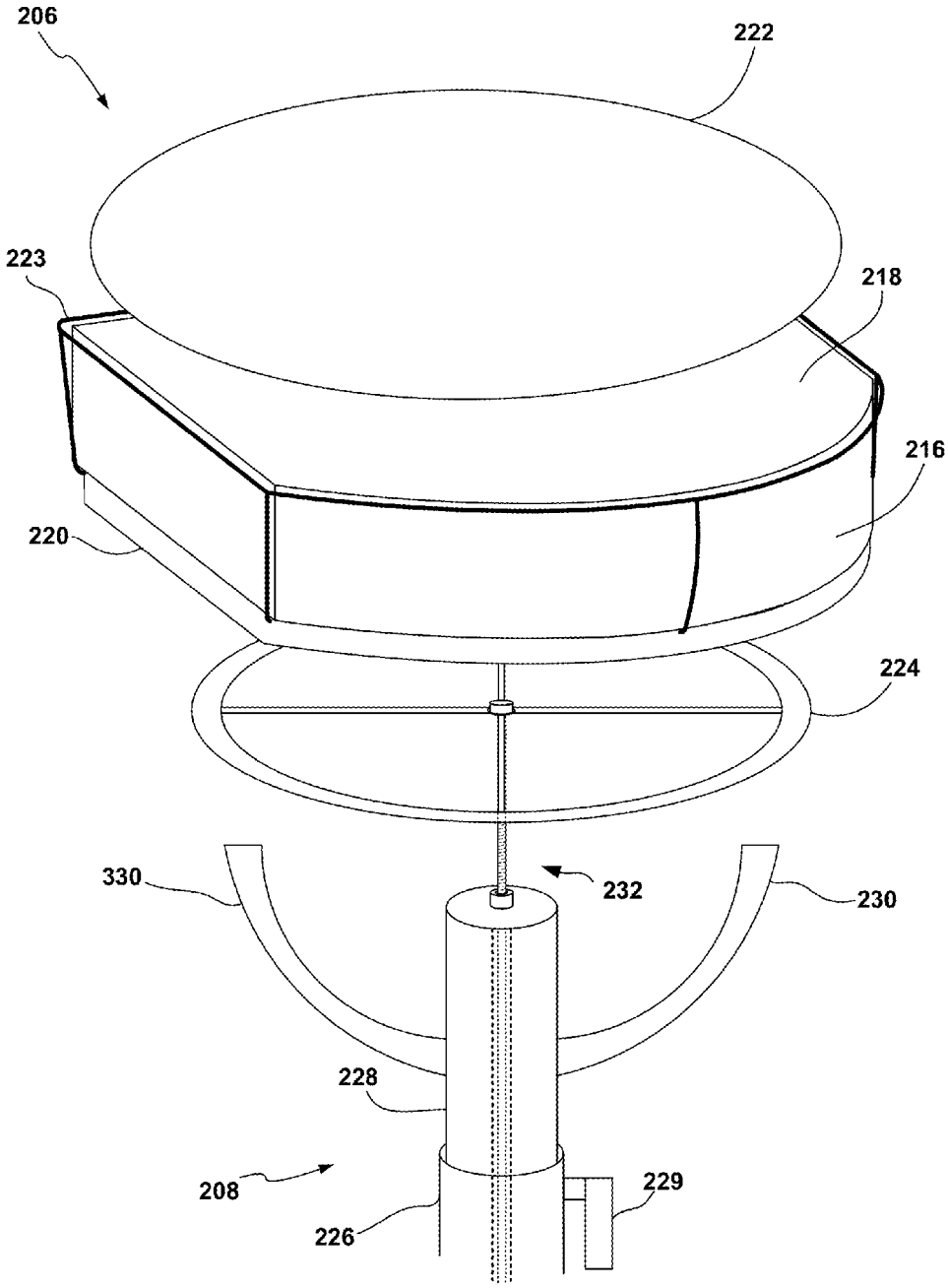
FIG. 4 is an exploded perspective view of one embodiment of a pad assembly and a stand assembly of a compact electronic timpani assembly consistent with the present disclosure.

FIG. 4 is an exploded perspective view of one embodiment of a pad assembly 206 and a stand assembly 208 included in an electronic timpani assembly consistent with the present disclosure. As shown, the pad assembly 206 may include a pad member 216 having a striking surface 218 and a base 220 extending from a portion thereof. The pad assembly 206 may further include a head 222 configured to be positioned over at least the striking surface 218 of the pad member 216. The pad assembly 206 further includes a frame 223 positioned over the pad member 216. The frame 223 may provide an interface between the pad member 216 and the head 222. More specifically, the frame 223 may be configured to provide support for the head 222 when the head 222 is stretched over the pad member 216, thereby suspending a portion of the head 222 over a portion of the striking surface 218 of the pad member 216 (e.g. such that the head 222 does not rest directly on at least the striking surface 218 of the pad member 216).

The pad assembly 206 further includes a hoop member 224 configured to be coupled to the head 222 (shown in FIGS. 7-8) and maintain the head 222 in a position over the frame 223. The head 222 may be configured to resemble the playing portion of the head of a full-size acoustic timpani. In particular, the head 222 may provide substantially the same physical and/or performance characteristics as the head of an acoustic timpani, as will be described in greater detail herein.

The stand assembly 208 may include one or more support members configured to provide support to the pad assembly 206. In the illustrated embodiment, the stand assembly 208 may include a first support member 226 and a second support member 228. The first support member 226 may include a hollow, substantially tubular cross-section, wherein at least a portion of the second support member 228 may be positioned within the first support member 226. The stand assembly 208 may be height adjustable. In particular, the second support member 228 may be moveable within the first support member 226 in a telescoping configuration, wherein a height adjustment member 229 may be configured to fix the second support member 228 within the first support member 226 at a desired height, thereby providing height adjustability for the musician. The stand assembly 208 may further include one or more support brackets 230 extending from a portion of one of the first and second support members 226, 228. As shown, the support brackets 230 may extend from a portion of the second support member 228. The support brackets 230 may be configured to be coupled to a portion of the pad assembly 206. As shown, the support brackets 230 may be coupled to the base 220 of the pad member 216.

The stand assembly 208 may further include an adjustment mechanism 232 extending from a portion of the second support member 228 and configured to be coupled to the hoop member 224. The adjustment mechanism 232 may be configured to displace the hoop member 224 in relation to the frame 223 and pad member 216, thereby increasing or decreasing tension or tautness of the head 222, as will be described in greater detail herein.

Figure 5:
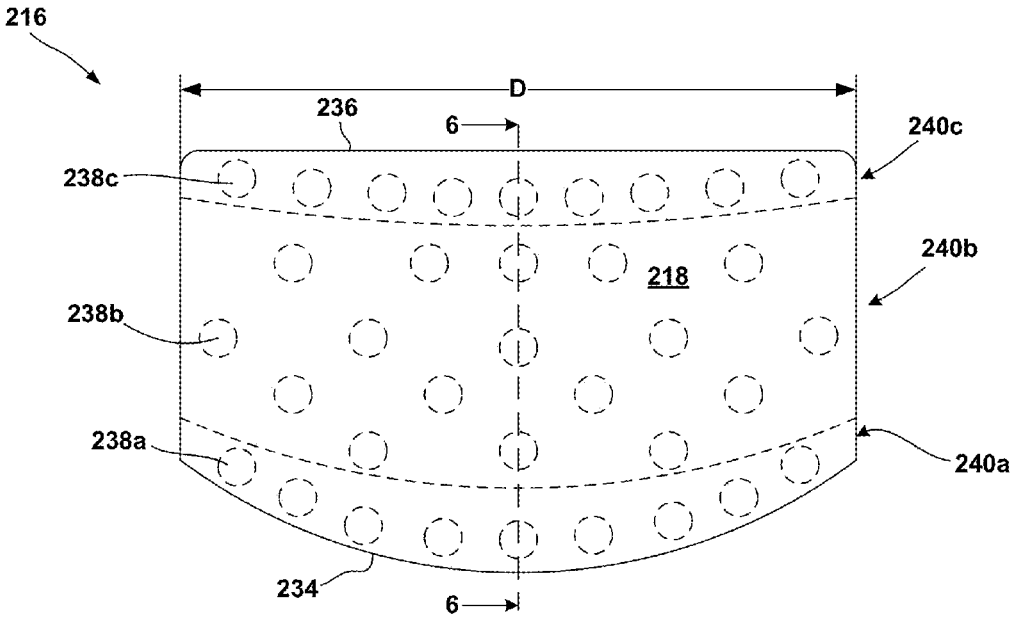
FIG. 5 is a top view of a portion of the pad assembly consistent with the present disclosure.
Figure 6:
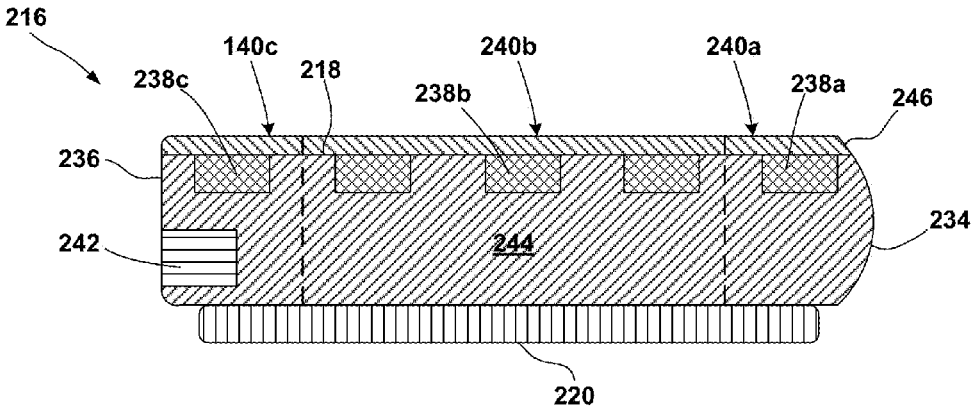
FIG. 6 is a sectional view of the pad taken along line 6-6 of FIG. 5.

FIG. 5 is a top view of a portion of the pad assembly consistent with the present disclosure and FIG. 6 is a sectional view of the pad taken along line 6-6 of FIG. 5. As previously described and illustrated in FIG. 3, the pad member 216 may be substantially smaller in size than a traditional acoustic timpani counterpart. The pad member 216 may be a fraction of the size of a corresponding acoustic timpani. For example, in one embodiment, the pad member 216 may have a diameter D that is substantially less than the diameter $D_1$ of timpani 102(1) (shown in FIG. 1). As such, the pad member 216 may have a striking surface 218 having an area substantially less than a total area of a striking surface (e.g. head) of an associated acoustic timpani). In one embodiment, the striking surface 218 of the pad member 216 may have an area approximately 20% the area of the striking surface of the head of an associated acoustic timpani. It should be noted that a pad member consistent with the present disclosure may have an area size that ranges from 15% to 80% of the area size of the associated acoustic timpani.

As shown, the pad member 216 may be shaped and/or sized to resemble the portion of an acoustic timpani head commonly struck by a musician during a performance. As shown, the pad member 216 may include a front edge 234 and a back edge 236. The front edge 234 may be shaped and/or sized to resemble the rim portion of an acoustic timpani and the back edge 236 may resemble a portion near the center of the acoustic timpani head.

The pad member 216 may further include one or more sensors 238*a*-238*c* positioned on a portion thereof. In particular, sensors 238*a*-238*c* may be positioned on the striking surface 218. Each of the sensors 238*a*-238*c* may be configured to sense impact strikes upon the striking surface 218 and determine characteristics of each strike. For example, each sensor 238*a*-238*c* may be configured to capture and determine data related to strength of impact, velocity of impact, location of impact, and/or hardness of a striking instrument (e.g. mallet) which comes into contact with the striking surface 218 of the pad member 216. In one embodiment, the sensors 238*a*-238*c* may include a piezoelectric sensor. It should be noted that the sensors 238*a*-238*c* may include any known sensors configured to receive, process and/or transmit input data in the form of an impact strike.

As shown, the pad member 216 may be sectioned into different areas (hereinafter referred to as "zones"). In the illustrated embodiment, the pad member 216 may include first, second and third zones 240*a*-240*c*. The first zone 240*a* is positioned adjacent the front edge 234 of the pad member 216 and includes one or more first sensors 238*a* and the third zone 240*c* is positioned adjacent the back edge 236 of the pad member 216 and includes one or more third sensors 238*c*. The second zone 240*b* is positioned between the first and third zones 240*a*, 240*c*, and includes one or more second sensors 238*b*.

The different zones of the pad member 216 have specific sound characteristics associated with each. For example, the first zone 240*a* may be configured to replicate the rim portion of the head of an associated acoustic timpani, wherein the first sensors 238*a* may be configured to produce a "thin" tone if the player strikes the first zone 240*a*. The second zone 240*b* may be configured to replicate the "sweet spot" of the head of an associated acoustic timpani, wherein the second sensors 238*b* are configured to produce the most desirable tone when struck (e.g. pure tone and pitch). The third zone 240*c* may be configured to replicate the center portion of the head of an associated acoustic timpani, wherein the third sensors 238*c* may be configured to produce a "dull" or "hollow" tone when struck. The third zone 240*c* may also be referred to as a "dead zone" (e.g. without pitch and/or tone).

In one embodiment, some of the sensors (e.g. first sensors 238*a*) positioned in the first zone 240*a* and adjacent the front edge 234 of the pad member 216, may be touch-specific (i.e. configured to sense touch of a musician's hands and/or fingers) and may allow a musician to tune the timpani assembly 202, as described in greater detail herein.

Turning to FIG. 6, an electronic timpani assembly consistent with the present disclosure may include at least one signal processing module 242 configured communicate with and receive captured data corresponding to an impact strike from at least one of the sensors 238*a*-238*c*. The signal processing module 242 may include a database of audio files related to musical tones. The musical tones, for example, may include coded data and/or sampled data obtained by sampling actual waveform signals produced by an acoustic timpani. The musical tones may include analogue, sampled and/or synthesized coded and/or sampled data. Upon receiving captured data from at least one of the sensors 238*a*-238*c*, the signal processing module 242 may be configured to determine a musical tone associated with the captured data of a corresponding impact strike. The signal processing module 242 may further be configured to produce a sound signal corresponding to the musical tone and communicate with and transfer the sound signal to the audio output device 204 to be reproduced into audible sound.

As previously described, the sensors 238*a*-238*c* may be configured to sense a variety of characteristics of an impact strike and, in turn, the signal processing module 242 may be configured to determine a corresponding musical tone consistent with a particular impact strike. For example, depending on the location (i.e. the zone) upon which the musician strikes the striking surface 218, the signal processing module 242 may determine a different associated musical tone. For example, an impact strike in the first zone 240*a* of the pad member 216 may result in a different musical tone than an impact strike in the second or third zones 240*b*, 240*c*. As such, the pad member 216 may be configured to allow a musician to execute a variety of playing techniques similar to that of an acoustic timpani.

As shown in FIG. 6, the sensors 238*a*-238*c* are imbedded within a body portion 244 of the pad member 216. The body portion 244 may include a resilient and durable material configured to withstand impact strikes. Additionally the sensors 238*a*-238*c* may be covered by a cushion member 246 configured to prevent a striking instrument (e.g. mallet) from directly contacting the sensors 238*a*-238*c*. As such, the cushion member 246 may serve as the striking surface 218 of the pad member 216. The cushion member 246 may include a resilient and durable material. In one embodiment, the cushion member 246 may include the same or similar material as the body portion 244.

Each of the sensors 238*a*-238*c* may be coupled to the signal processing module 242 via any known communication link. In one embodiment, the sensors 238*a*-238*c* are coupled to the signal processing module 242 via a wired-connection, such as a cable (not shown). In another embodiment, the sensors 238*a*-238*c* are coupled to the signal processing module 242 via a wireless connection. Yet still, in another embodiment, some of the sensors 238*a*-238*c* may be coupled via a wired-connection and some of the sensors 238*a*-238*c* may be coupled via a wireless connection.

It should be noted that in other embodiments, the signal processing module 242 may be separate from the pad member 216. For example, as previously described, the sensors 238*a*-238*c* may be configured to wirelessly communicate with the signal processing module 242. As such, in some embodiments, the signal processing module 242 may be separate from the pad member 216 and sensors 238*a*-238*c* (i.e. not embedded within the pad member 216). For example, in one embodiment, the signal processing module 242 may be included within a different component of the electronic timpani assembly (e.g., but not limited to, tuning pedal 210, audio output device 204, etc.). In another embodiment, the signal processing module 242 may be a separate, stand-alone component. Yet still, in another embodiment, the signal processing module 242 may include software embodied as a software package, code and/or instruction set or instructions embodied on a computing device (e.g., but not limited to, PC, smartphone, personal media player, etc.).

Figure 7:
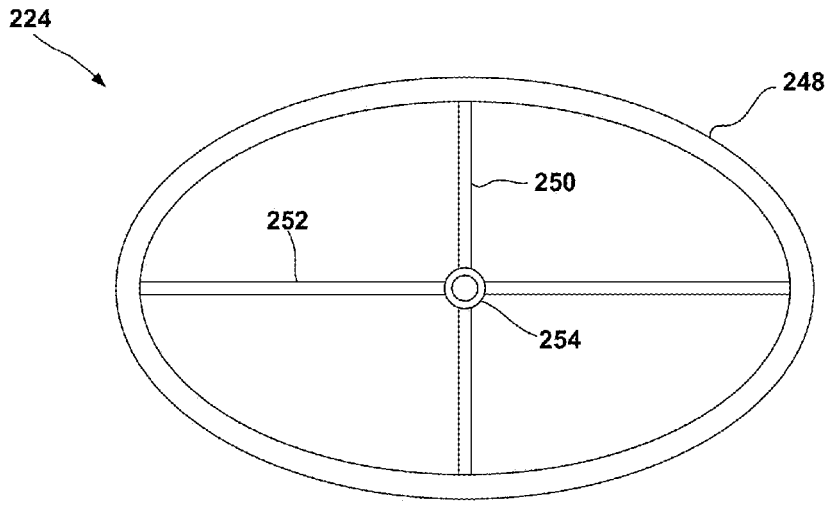
FIG. 7 is a top view of a hoop member of the pad assembly of FIG. 4 consistent with the present disclosure.
Figure 8:
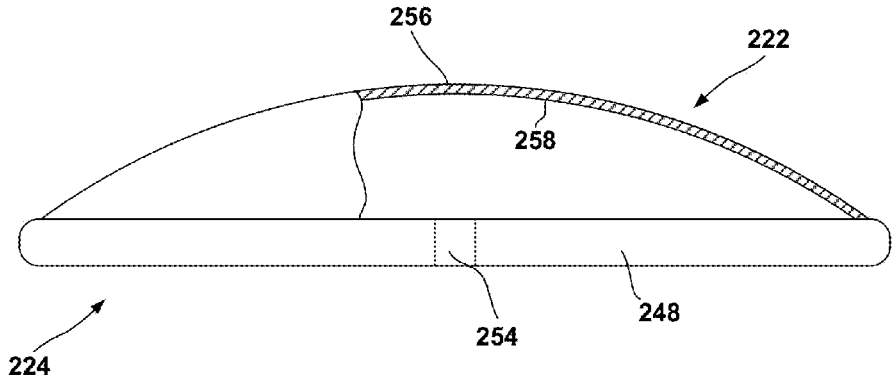
FIG. 8 is a side view, partly in section, of the head coupled to the hoop member consistent with the present disclosure.

FIG. 7 is a top view of the hoop member 224 of the pad assembly consistent with the present disclosure and FIG. 8 is a side view, partly in section, of the head 222 coupled to the hoop member 224. It should be noted that internal features and/or surfaces are illustrated in phantom. As shown, the hoop member 224 may include a rim 248 and one or more cross-bars 250, 252 extending from one end of the rim 248 to another end of the rim 248. The hoop member 224 may further include an attachment member 254 positioned at or near a center of the rim 248. The attachment member 254 may be configured to couple the hoop member 224 to a portion of the adjustment mechanism 232, as described in greater detail herein.

As shown in FIG. 8, at least a portion of the periphery of head 222 may be secured to the rim 248 of the hoop member 224. The head 222 may be secured to the rim 248 by a variety of means, such as, for example, adhesives or known crimping methods. The head 222 may include an outer surface 256 and an inner surface 258. When the pad assembly 206 is fully assembled (shown in FIG. 8), the head 222 is configured to fit over the pad member 216, wherein the inner surface 258 of the head 222 may contact and be stretched over portions of the frame 223 and the outer surface 256 may receive impact strikes from the striking instrument.

Figure 9:
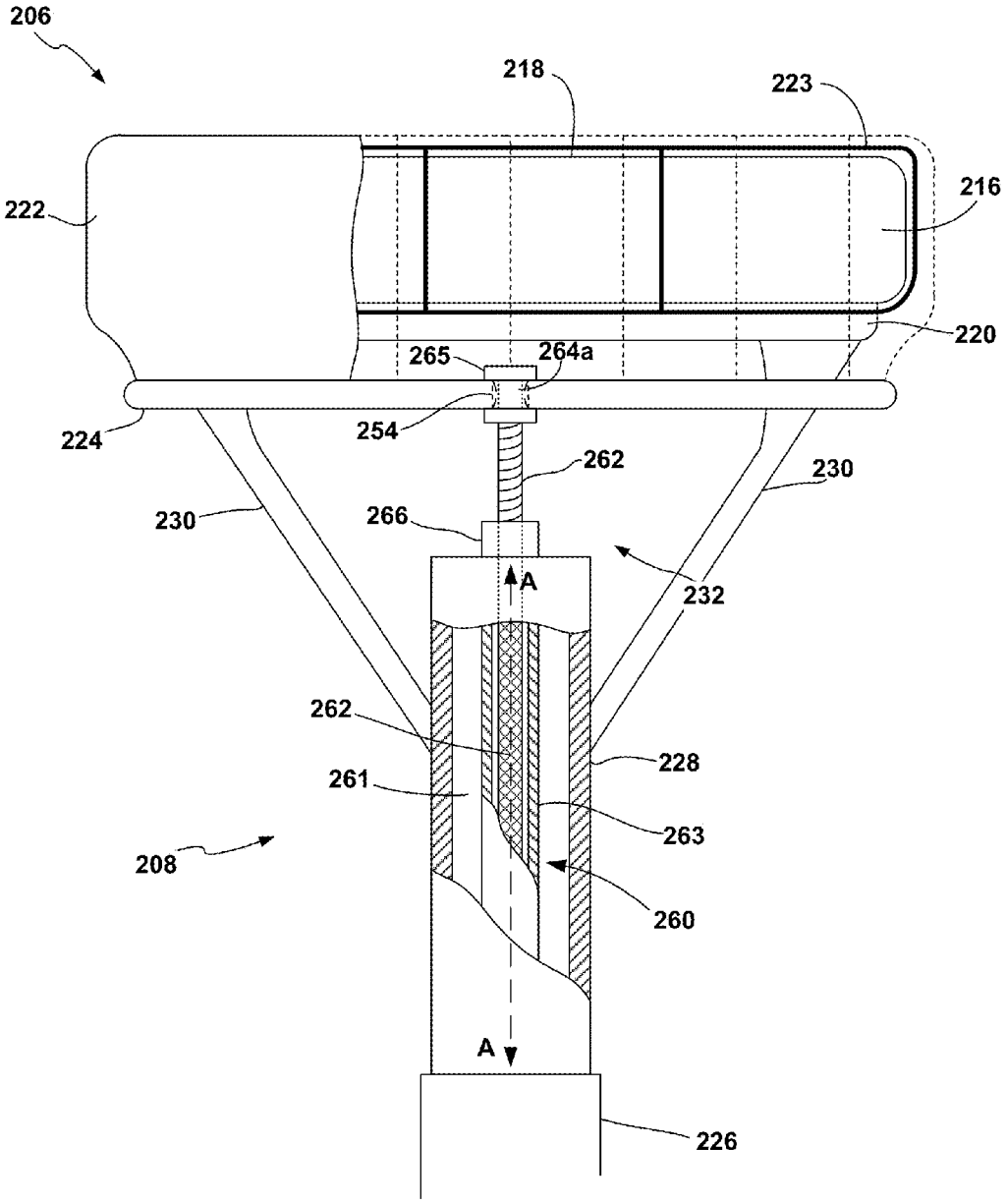
FIG. 9 is a side view, partly in section, of a portion of the compact electronic timpani assembly including the pad and stand assemblies of FIG. 4 in an assembled state.

FIG. 9 is a side view, partly in section, of a portion of the electronic timpani assembly 202 including the pad and stand assemblies 206, 208 in an assembled state. It should be noted that internal features and/or surfaces are illustrated in phantom. As shown, the pad assembly 206 may be coupled to the stand assembly 208 by way of the support brackets 230. In particular, the support brackets 230 may extend from the second support member 228 and may be coupled to the base 220 of the pad member 216.

As shown, the head 222 may be fitted over the frame 223 and the pad member 216. The head 222 may include a resilient and durable material capable of elastic expansion when a force is applied thereto and elastic recovery when the force is removed therefrom. In particular, the head 222 may be capable elastically conforming to the shape of the frame 223 when positioned over of portion thereof. The material may include, but is not limited to, either natural or synthetic materials such as polymers and/or co-polymers. Examples may include polyurethane, latex, natural rubber, nylon (polyamides), polyester, polyethylene, polypropylene, PVC, fluoroplastics, block copolymers, polyethers and composites thereof.

In the illustrated embodiment, the second support member 228 may include a hollow, substantially tubular cross-section, wherein a portion of the adjustment mechanism 232 may be positioned within the second support member 228. As described in greater detail herein, the adjustment mechanism 232 may be configured to adjust tension of the head 222. In the illustrated embodiment, the adjustment mechanism 232 may include, for example, a cable 260, such as, for example, a Bowden cable, disposed within an interior 261 of the second support member 228. The cable 260 may further extend from the interior 261 of the second support member 228 to an interior of the first support member 226 and eventually pass through a portion of the first support member 226 and be coupled to a tuning pedal consistent with the present disclosure.

The cable 260 may include at least an inner cable 262 enclosed within a portion of an outer sleeve 263. The inner cable 262 may include a first end 264*a* and a second end (shown in FIGS. 10A and 10B). As shown, the first end 264*a* of the inner cable 262 extends from the second support member 228 is coupled to the hoop member 224. More specifically, the first end 264*a* may be coupled to the attachment member 254 of the hoop member 224 by way of a first fastener 265. The first fastener 265 may be configured to securely fix the first end 264*a* of the inner cable 262 to the hoop member 224 such that movement of the inner cable 262 causes the hoop member 224 to correspondingly move. As such, the first fastener 265 may serve as a fixed anchor point of the inner cable 262. The cable 260 may be coupled to a portion of the second support member 228 by way of a second fastener 266. In the illustrated embodiment, the second fastener 266 may configured to adjust tension of the inner cable 262. As such, the second fastener 266 may include an inline hollow bolt (e.g. a barrel adjuster) configured to lengthen or shorten the outer sleeve 263 relative to the fixed anchor point (e.g. first end 264*a* fastened to attachment member 254).

As described in greater detail herein, the adjustment mechanism 232 further includes a driving mechanism (shown in FIGS. 10A-10B) configured to move the inner cable 262 in a substantially linear direction along a longitudinal axis A of the first and second support members 226, 228. More specifically, the driving mechanism is configured to move the inner cable 262, specifically the first end 264*a*, in a first direction away from pad member 216 and towards the second support member 228, thereby drawing the inner cable 262 within the second support member 228. The driving mechanism is further configured to move the inner cable 262, specifically the first end 264*a*, in a second direction towards the pad member 216 and away from the second support member 228.

The head 222 may be configured to resemble the head of a full-size acoustic timpani. In particular, the tension of the head 222 may be adjusted, particularly by operation of the cable 260, wherein, depending on the degree of tension, the head 222 may have substantially the same rebounding characteristics of the head of an acoustic timpani when struck by a mallet or other striking instrument. As such, the head 222 may provide substantially the same physical and/or performance characteristics as the head of a full-size acoustic timpani.

Figure 10A:
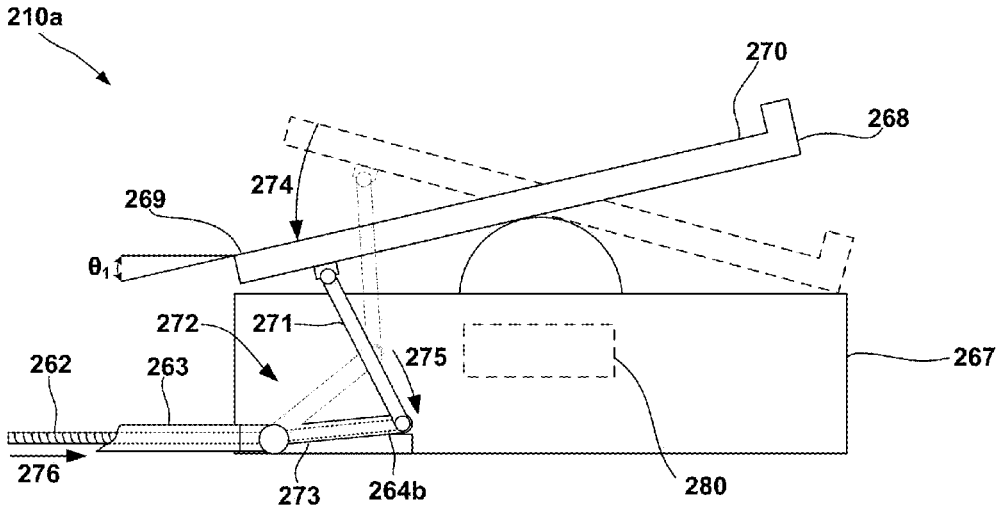
FIGS. 10A-10B are side views of one embodiment of a tuning pedal of the compact electronic timpani assembly of FIG. 9 moving between first and second positions.
Figure 10B:
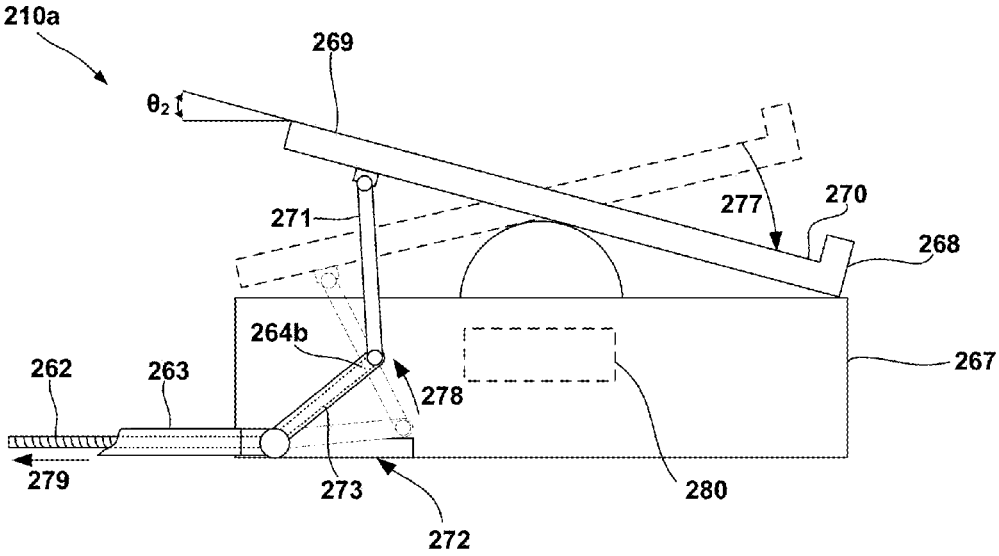

FIGS. 10A-10B are side views of one embodiment of a tuning pedal 210*a* configured to be used with the adjustment mechanism 232 of the electronic timpani assembly 206 of FIG. 9. FIG. 10A illustrates the tuning pedal 210*a* moving from a first position to a second position. As previously described, the tuning pedal 210*a* may be configured to adjust the pitch of the musical tone associated with an impact strike upon the pad 216. The tuning pedal 210*a* may further be configured to adjust the tension of the head 222 to resemble the rebounding characteristics associated with a selected pitch. In particular, the tuning pedal 210*a* may be configured to control operation of the adjustment mechanism 232, which, in turn, may adjust the position of the hoop member 224 and thereby increase or decrease tension of the head 222 depending on the desired pitch, as will be described in greater detail herein. Generally, a higher pitch may be associated with an increase in tension and a lower pitch may be associated with a decrease in tension.

Generally, the tuning pedal 210*a* may include a base 267 and a foot platform 268 pivotably coupled to a portion of the base 267. The foot platform 268 may be configured to resemble movement of pedal of a full-size acoustic timpani. In particular, the foot platform 268 may allow a musician to use their feet to control movement of the platform 268, and thereby selectively adjust the pitch and corresponding tension of the head 222. The foot platform 268 may include a toe portion 269 and a heel portion 270. As shown, the toe portion 269 may include a protrusion (e.g. lever 271) extending from a portion thereof. The lever 271 may be coupled to a portion of the driving mechanism 272 of the adjustment mechanism 232 and may be configured to transmit force from movement of the foot platform 268 to the driving mechanism. More specifically, the driving mechanism 272 may include, for example, a rotatable lever 273 having a second end 264*b* of the inner cable 262 coupled to a portion thereof.

As shown in FIG. 10A, as the toe portion 269 is depressed and moves in a direction toward the base 267, as indicated by arrow 274, lever 271 transmits the downward force of the toe portion 269 to the rotatable lever 273, thereby causing the rotatable lever 273 to move from a first position to a second position, as indicated by arrow 275. Movement of the rotatable lever 273 from the first position to the second position causes the second end 264*b* of the inner cable 262 to move in the first direction, as indicated by arrow 276, thereby causing the first end 264*a* of the inner cable 262 to exert a pulling force on the hoop member 224. In turn, the tension of the head 222 may correspondingly increase and the pitch of a musical tone associated with an impact strike may rise.

FIG. 10B illustrates the tuning pedal 210*a* moving from the second position to the first position. As shown, as the heel portion 270 is depressed and moves in a direction toward the base 267, as indicated by arrow 277, lever 271 transmits the upward force of the toe portion 269 to the rotatable lever 273, thereby causing the rotatable lever 273 to move from the second position to the first position, as indicated by arrow 278. Movement of the rotatable lever 273 from the second position to the first position causes the second end 264*b* of the inner cable 262 to move in the second direction, as indicated by arrow 279, thereby causing the first end 264*a* of the inner cable 262 to move in a direction towards the pad member 216 and lessen a pulling force on the hoop member 224. In turn, the tension of the head 222 may correspondingly decrease and the pitch of a musical tone associated with an impact strike may lower.

An electronic timpani assembly consistent with the present disclosure may further include a pitch identification module 280 configured to identify a pitch corresponding to the tension of the head 222. More specifically, the pitch identification module 280 may be configured to monitor one or more parameters corresponding to the tension of the head 222 and identify an associated pitch corresponding to the tension. The parameters may include, but are not limited to, movement and/or position of the foot platform 268 of the tuning pedal 210*a*, movement and/or position of the rotatable lever 273 of the driving mechanism 272 and movement and/or position of a portion of the inner cable 262. As generally understood by one skilled in the art, the pitch identification module 280 may include one or more sensors (not shown) configured to monitor movement and determine one or more positions of, for example, the foot platform 268 of the tuning pedal 210*a*, the rotatable lever 273 of the driving mechanism 272 and/or a portion of the inner cable 262.

The pitch identification module 280 is configured to communicate with and provide data related to the identified pitch with the signal processing module 242. Upon receiving the data from the pitch identification module 280, the signal processing module 242 may be configured to determine a musical tone associated with the data related to the identified pitch and produce a sound signal corresponding to the musical tone. The pitch identification module 280 may further be configured to communicate with and provide data related to the identified pitch with the tuning gauge 212, as described in greater detail herein.

The pitch identification module 280 may be coupled to the signal processing module 242 via any known communication link. In one embodiment, the pitch identification module 280 may be coupled to the signal processing module 242 via a wired-connection, such as a cable (not shown). In another embodiment, the pitch identification module 280 may be coupled to the signal processing module 242 via a wireless connection.

As shown in FIGS. 10A and 10B, the tuning pedal 210*a* may include a pitch identification module 280. In the illustrated embodiment, the pitch identification module 280 may be configured to determine one or more positions of the foot platform 268 relative to the base 267 and identify a pitch associated with each position, wherein the identified pitch corresponds to the tension of the head 222. For example, in one embodiment, the pitch identification module 280 may include one or more sensors (not shown) configured capture data related to a position of the foot platform 268 relative to the base 267, such as, for example, an angle formed between the platform 268 and the base 267.

As shown in FIG. 10A, the foot platform 268 moves from a first position (indicated in phantom) to a second position (the toe portion 269 moves in a direction towards the base 267), thereby causing the tension of the head 222 to increase, as described earlier. The pitch identification module 280 may be configured to determine the position of the foot platform 268 relative to the base 267. In particular, the pitch identification module 280 may determine a first angle $\theta_1$ formed between the foot platform 268 and the base 267 and identify a first pitch associated with the first angle $\theta_1$ and corresponding to the tension of the head 222.

As shown in FIG. 10B, the foot platform 268 moves from the second position (indicated in phantom) to the first position (heel portion 270 moves in a direction towards the base 267), thereby causing the tension of the head 222 to decrease, as described earlier. The pitch identification module 280 may determine a second angle $\theta_2$ formed between the foot platform 268 and the base 267 and identify a second pitch associated with the second angle $\theta_2$ and corresponding to the tension of the head 222.

As generally understood, the tension of the head 222 may increase when the foot platform 268 moves from the first position to the second position (shown in FIG. 10B) and may decrease when the foot platform 268 moves from the second position to the first position (shown in FIG. 10A). As such, the first pitch identified by the pitch identification module 280 when the foot platform 268 is in the second position is generally higher than the second pitch identified when the foot platform 268 is in the first position. It should be noted that the pitch identification module 280 may be configured to determine various positions of the foot platform 268 relative to the base 267 (i.e. angles formed between the foot platform 268 and base 267) and identify associated pitches with each of the positions and should not be limited to the first and second positions (i.e. first and second angles $\theta_1$, $\theta_2$) illustrated in FIGS. 10A and 10B.

In other embodiments, the pitch identification module 280 may be configured to monitor other parameters corresponding to the tension of the head 222 and identify a pitch associated with such. For example, in one embodiment, the pitch identification module 280 may be configured to monitor movement of the driving mechanism 272. More specifically, the pitch identification module 280 may include one or more sensors (not shown) configured to capture data related to one or more positions of the rotatable lever 273 relative to the base 267 and identify a pitch associated with each position, wherein the identified pitch corresponds to the tension of the head 222.

In another embodiment, the pitch identification module 280 may be configured to monitor movement of the inner cable 262 of the adjustment mechanism 232. More specifically, the pitch identification module 280 may be separate from the tuning pedal 210*a* and may be coupled to, for example, a portion of the stand assembly 208. The pitch identification module 280 may include one or more sensors (not shown) configured to capture data related to movement of the inner cable 262 and one or more positions of a portion of the inner cable 262 in a linear direction along the longitudinal axis A relative to the first and/or second support members 226, 228. The pitch identification module 280 may further be configured to identify a pitch associated with each position, the identified pitch corresponding to the tension of the head 222.

Figure 11A:
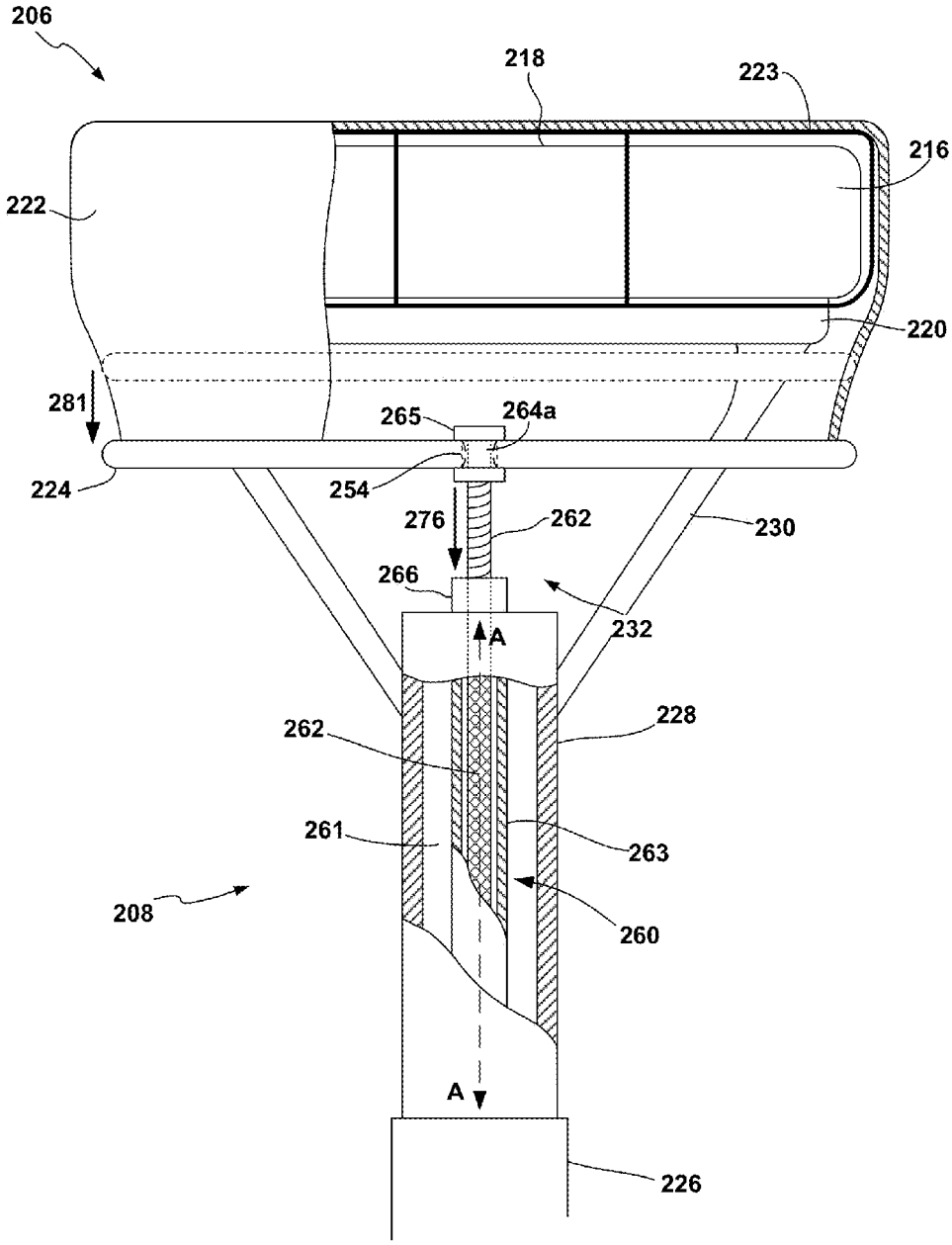
FIGS. 11A and 11B are side views, partly in section, of a portion of the compact electronic timpani assembly of FIG. 9 illustrating the hoop member moving between first and second positions.
Figure 11B:
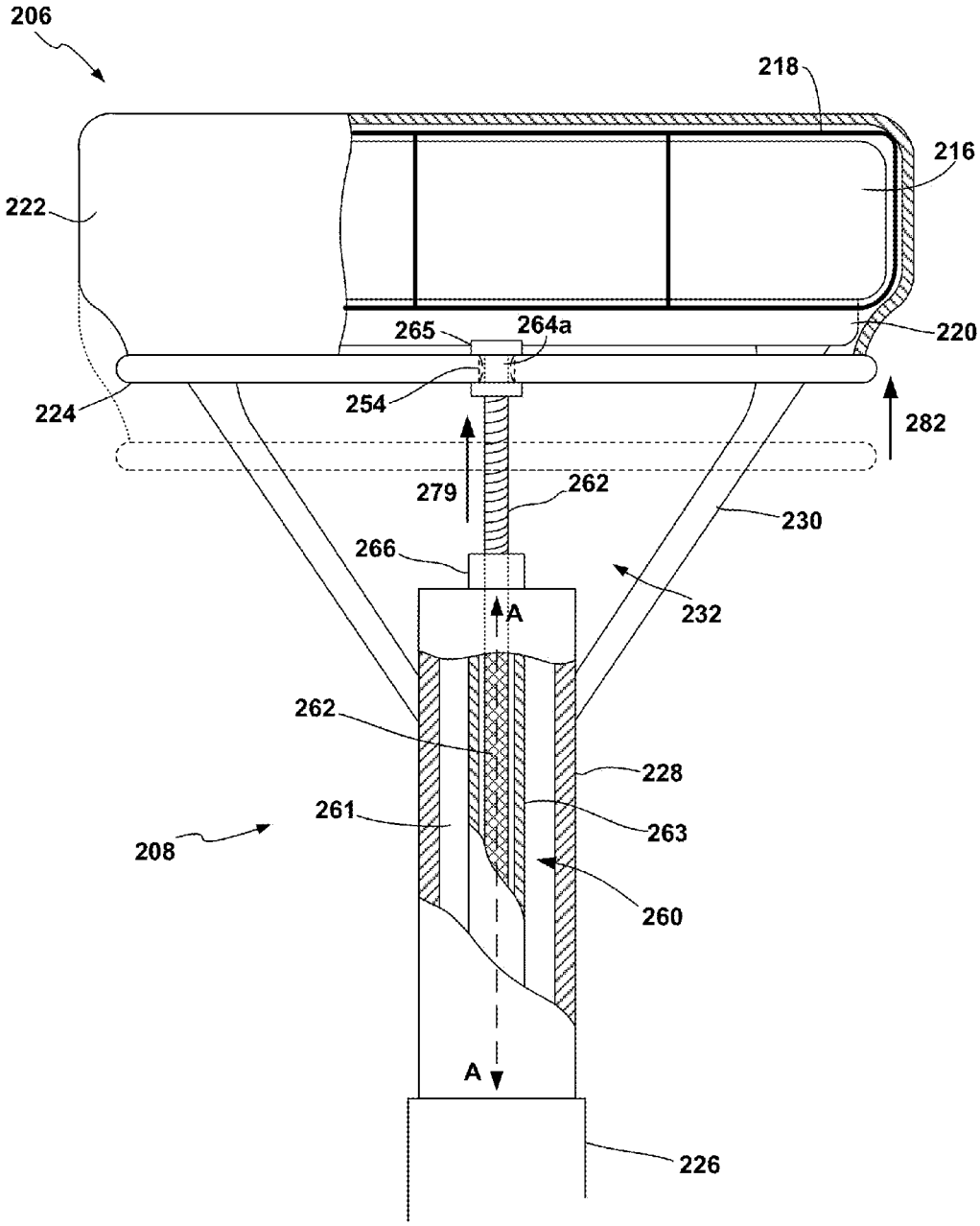

FIGS. 11A and 11B are side views, partly in section, of a portion of the electronic timpani assembly of FIG. 9 illustrating the hoop member moving between first and second positions. As previously described, the tuning pedal 210*a* may be configured to cooperate with and control the driving mechanism 272 of the adjustment mechanism 232, thereby controlling the tension of the head 222.

Referring to FIG. 11A, the hoop member 224 is illustrated moving from a first position to a second position. Generally, a higher pitch may be associated with an increase in tension of the head 222. As previously described, in the event a musician desires to raise the pitch and corresponding tension of the head 222, the toe portion 269 of the foot platform 268 may be depressed (shown in FIG. 10A). By depressing the toe portion 269, the driving mechanism 272 of the adjustment mechanism 232 moves from a first position to a second position and causes the inner cable 262 to move in a first direction, as indicated by arrow 276, away from the pad member 216, thereby causing the first end 264*a* of the inner cable 262 to exert a pulling force on the hoop member 224 in a direction away from the pad member 216 and towards the second support member 228. In turn, the hoop member 224 coupled to the first end 264*a* of the inner cable 262 is also drawn in a direction towards the second support member 228, as indicated by arrow 281, wherein the hoop member 224 moves from a first position (indicated in phantom) to a second position. When the hoop member 224 is moved in a direction away from the striking surface 218 of the pad member 216, the tension of the head 222 increases and becomes more taught.

Referring to FIG. 11B, the hoop member 224 is illustrated moving from the second position to the first position. Generally, a lower pitch may be associated with a decrease in tension of the head 222. In the event a musician desires to lower the pitch, the heel portion 270 of the foot platform 268 may be depressed (shown in FIG. 10B). By depressing the heel portion 270, the driving mechanism 272 of the adjustment mechanism 232 moves from the second position to the first position and causes the inner cable 262 to move in a second direction, as indicated by arrow 279, towards the pad member 216. In turn, the hoop member 224 coupled to the first end 264*a* of the inner cable 262 also moves in a direction towards the pad member 216, as indicated by arrow 282, wherein the hoop member 224 moves from the second position (indicated in phantom) to the first position. When the hoop member 224 is moved in a direction towards the striking surface 218 of the pad member 216, the tension of the head 222 decreases and becomes less taught. It should be noted that the tuning pedal 210*a* may be configured to apply a force to the driving mechanism 272 so as to move the inner cable 262 and ultimately the hoop member 224 to various positions to achieve various degrees of tension in the head 222 and should not be limited to the first and second positions illustrated in FIGS. 11A and 11B.

Figure 12:
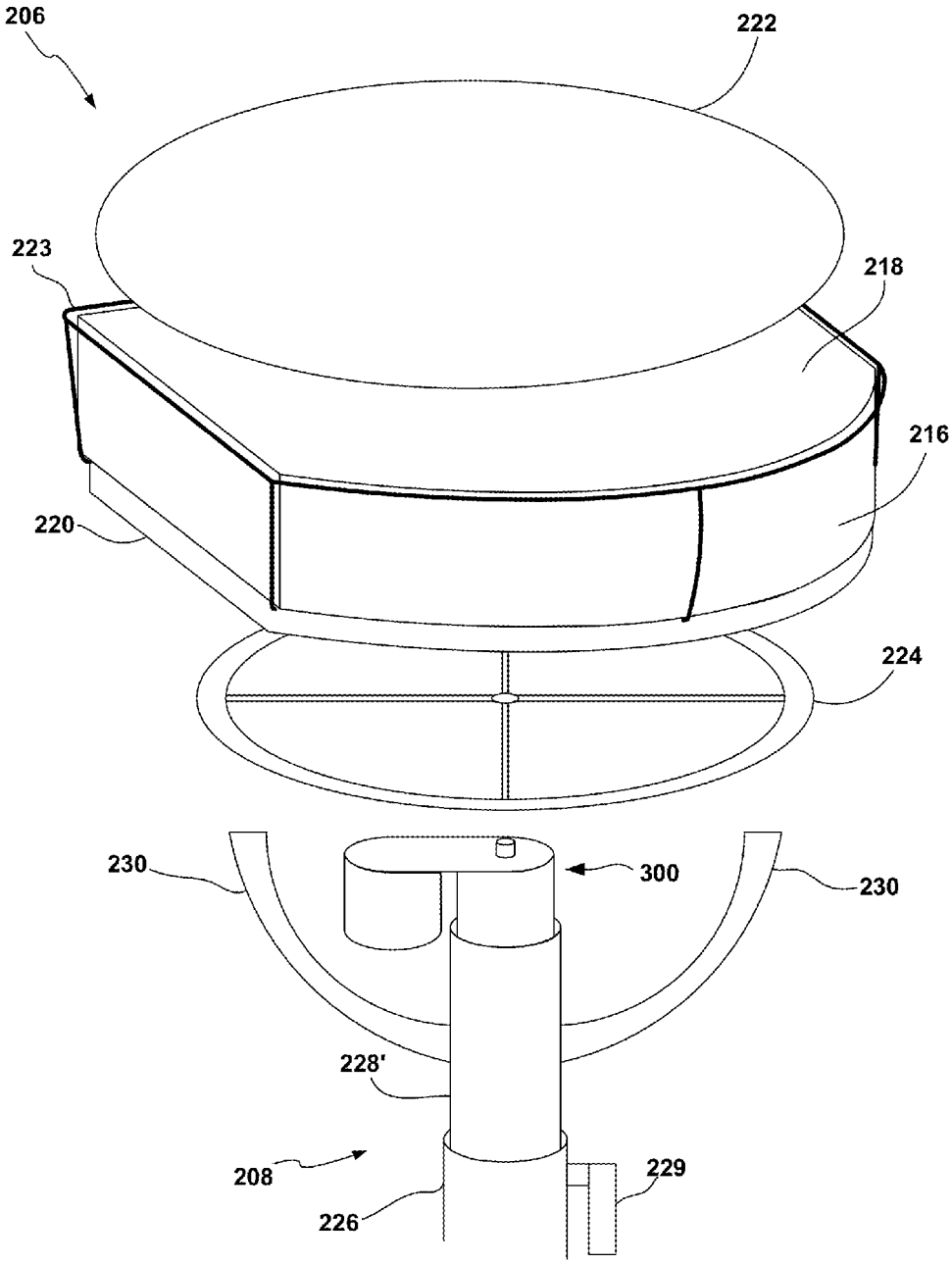
FIG. 12 is an exploded perspective view of another embodiment of a pad assembly and a stand assembly of a compact electronic timpani assembly consistent with the present disclosure.

FIG. 12 is an exploded perspective view of a pad assembly and a stand assembly including another embodiment of an adjustment mechanism consistent with the present disclosure. These embodiments are similar to the embodiments of FIG. 9, and like components have been assigned like reference numerals. Accordingly, discussion may be limited to describing the alternative embodiment of the adjustment mechanism 300. As shown, the stand assembly 208 may include an adjustment mechanism 300 extending from a portion of the second support member 228' and configured to be coupled to the hoop member 224. The adjustment mechanism 300 may be configured to displace the hoop member 224 in relation to the frame 223 and pad member 216, thereby increasing or decreasing tension of the head 222, as will be described in greater detail herein.

Figure 13:
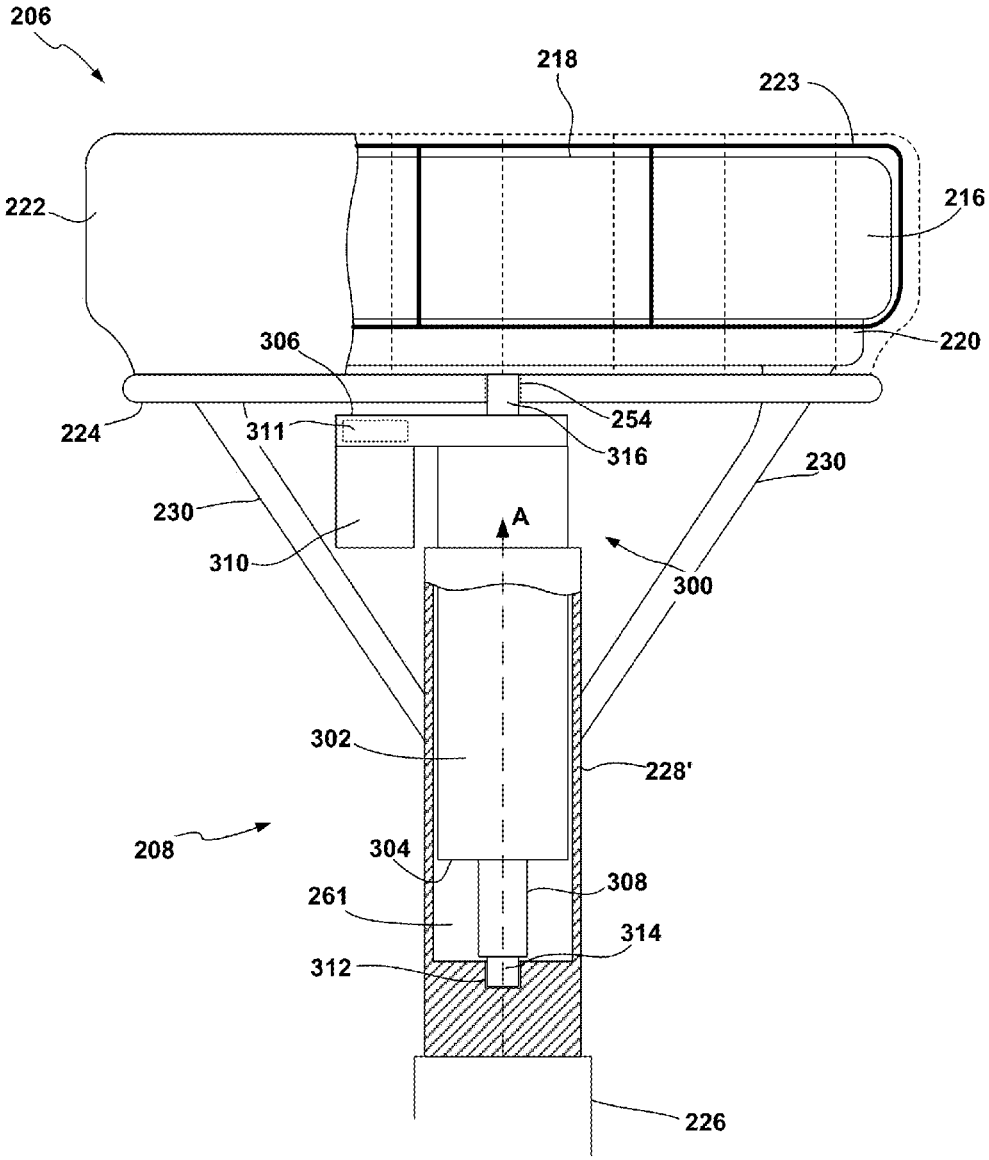
FIG. 13 is a side view, partly in section, of a portion of the compact electronic timpani assembly including the pad and stand assemblies of FIG. 12 in an assembled state.

FIG. 13 is a side view, partly in section, of a portion of the electronic timpani assembly including the pad and stand assemblies of FIG. 12 in an assembled state. It should be noted that internal features and/or surfaces are illustrated in phantom. As shown, the second support member 228' may include a hollow, substantially tubular cross-section, wherein a portion of the adjustment mechanism 300 may be positioned within. As described in greater detail herein, the adjustment mechanism 300 may be configured to adjust tension of the head 222. In the illustrated embodiment, the adjustment mechanism 300 may include, for example, a linear actuator (hereinafter referred to as "linear actuator 300").

The linear actuator 300 may include a housing 302 having a first end 304 and an opposing second end 306. The housing 302 may include a rod member 308 disposed within the housing 302 and extending from the first end 304. The linear actuator 300 may further include a driving mechanism 310 (e.g. a motor) configured to move the rod member 308 in a linear direction along a longitudinal axis A of the second support member 228'. In particular, the driving mechanism 310 may be configured to move the rod member 308 in a first direction extending away from the first end 304 of the housing 302 and towards the second support member 228'. The driving mechanism 310 may further be configured to move the rod member 308 in a second direction towards the first end 304 of the housing 302 and away from the second support member 228', thereby drawing the rod member 308 back within the housing 302. The linear actuator 300 may further include circuitry, such as, for example a controller 311, configured to receive input from a musician and selectively energize the driving mechanism 310, as will be described in greater detail herein.

As shown, at least the first end 304 of the housing 302 and the rod member 308 may be positioned within an interior 261 of the second support member 228'. The second support member 228' may include an attachment member 312 within a portion of the interior 261, wherein a distal end 314 of the rod member 308 may be coupled and fixed thereto. In particular, the attachment member 312 may be shaped and/or sized for receiving at least a portion of the distal end 314 of the rod member 308 and securing the distal end 314 to the attachment member 312. As understood by one skilled in the art, the distal end 314 of the rod member 308 may be coupled to the attachment member 312 by any known means. In one embodiment, the attachment member 312 may include an internally threaded bore and the distal end 314 of the rod member 308 may define a threaded surface, wherein the threads may have sufficient size and pitch so as to be able to accept and be coupled to the attachment member 312 and secure the rod member 308 and, in turn, the linear actuator 300, to the second support member 228'.

The second end 306 of the housing 302 of the linear actuator 300 may include a protrusion 316 extending therefrom. The protrusion 316 may be configured to secure the hoop member 224 to the linear actuator 300. In particular, the protrusion may be configured to be coupled to the attachment member 254 of the hoop member 224, wherein the attachment member 254 may be shaped and/or sized for receiving at least a portion of the protrusion 316 and securing the protrusion 316 to the attachment member 254. In one embodiment, the attachment member 254 may include an internally threaded bore and the protrusion 316 may define a threaded surface, wherein the threads may have sufficient size and pitch so as to be able to accept and be coupled to the attachment member 254 and secure hoop member 224 to the linear actuator 300.

Figure 14A:
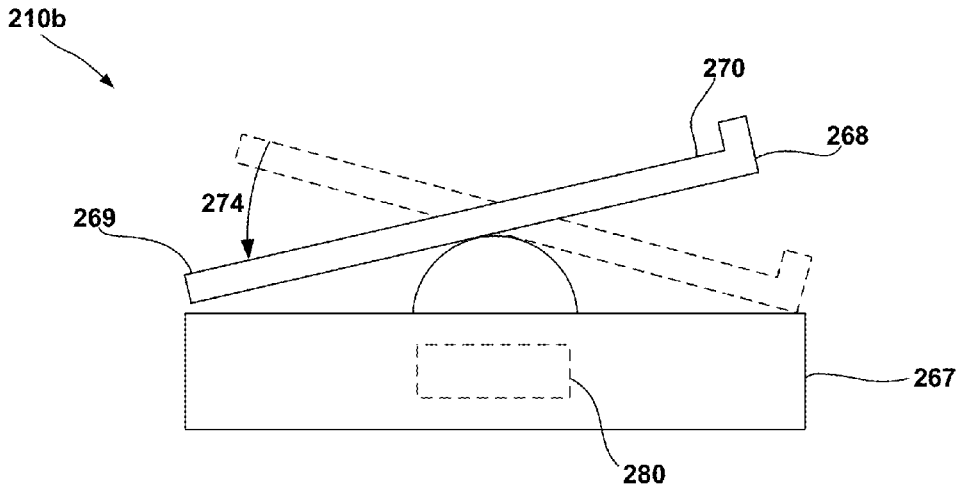
FIGS. 14A and 14B are side views of one embodiment of a tuning pedal of the compact electronic timpani assembly of FIG. 13 moving between first and second positions.
Figure 14B:
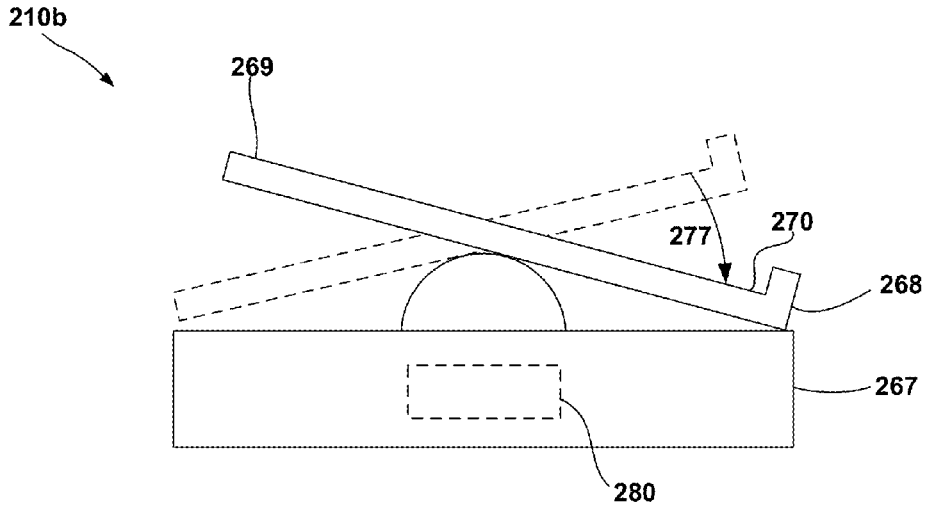

FIGS. 14A and 14B are side views of another embodiment of a tuning pedal 210*b* of the electronic timpani assembly of FIG. 13 moving between first and second positions. This embodiment is similar to the embodiment of FIGS. 10A and 10B, and like components have been assigned like reference numerals. The tuning pedal 210*b* may be configured to adjust the pitch of the musical tone associated with an impact strike upon the pad 216. The tuning pedal 210*b* may further be configured to adjust the tension of the head 222 to resemble the rebounding characteristics associated with a selected pitch. More specifically, the tuning pedal 210*b* may be configured to control operation of the linear actuator 300, which, in turn, may adjust the position of the hoop member 224 and thereby increase or decrease tension of the head 222 depending on the desired pitch, as will be described in greater detail herein. Generally, a higher pitch may be associated with an increase in tension and a lower pitch may be associated with a decrease in tension.

Referring to FIG. 14A, the tuning pedal 210*b* is illustrated moving from a first position to a second position. As shown, as the toe portion 269 is depressed and moves in a direction toward the base 267, as indicated by arrow 274, the pitch of a musical tone associated with an impact strike may rise, and, in turn, the tension of the head 222 may correspondingly increase. As shown in FIG. 14B, as the heel portion 270 is depressed and moves in a direction toward the base 267, as indicated by arrow 277, the pitch of a musical tone associated with an impact strike may lower, and, in turn, the tension of the head 222 may correspondingly decrease.

As previously described, an electronic timpani assembly consistent with the present disclosure may include a pitch identification module 280 configured to identify a pitch corresponding to the tension of the head 222. In the illustrated embodiment, the pitch identification module 280 may be configured to monitor movement and determine one or more positions of the foot platform 268 of the tuning pedal 210*b* relative to the base 267. For example, the pitch identification module 280 may include one or more sensors (not shown) configured capture data related to a position of the foot platform 268 relative to the base 267 (e.g. angular position) and determine a pitch associated with each position.

The pitch identification module 280 may be configured to communicate with and control operation of the linear actuator 300. For example, in one embodiment, the pitch identification module 280 may be configured to transfer captured data related to a position of the foot platform 268 to the controller 311 of the linear actuator 300, and the controller 311 may be configured to energize the adjustment mechanism, e.g. motor 310, and move the rod member 308 in an associated direction, thereby adjusting tension of the head 222 to correspond to the position of the foot platform 268 and the identified pitch.

The pitch identification module 280 is further configured to communicate with and provide data related to the identified pitch with the signal processing module 242. Upon receiving the data from the pitch identification module 280, the signal processing module 242 may be configured to determine a musical tone associated with the data related to the identified pitch and produce a sound signal corresponding to the musical tone. The pitch identification module 280 may further be configured to communicate with and provide data related to the identified pitch with the tuning gauge 212, as described in greater detail herein.

Figure 15A:
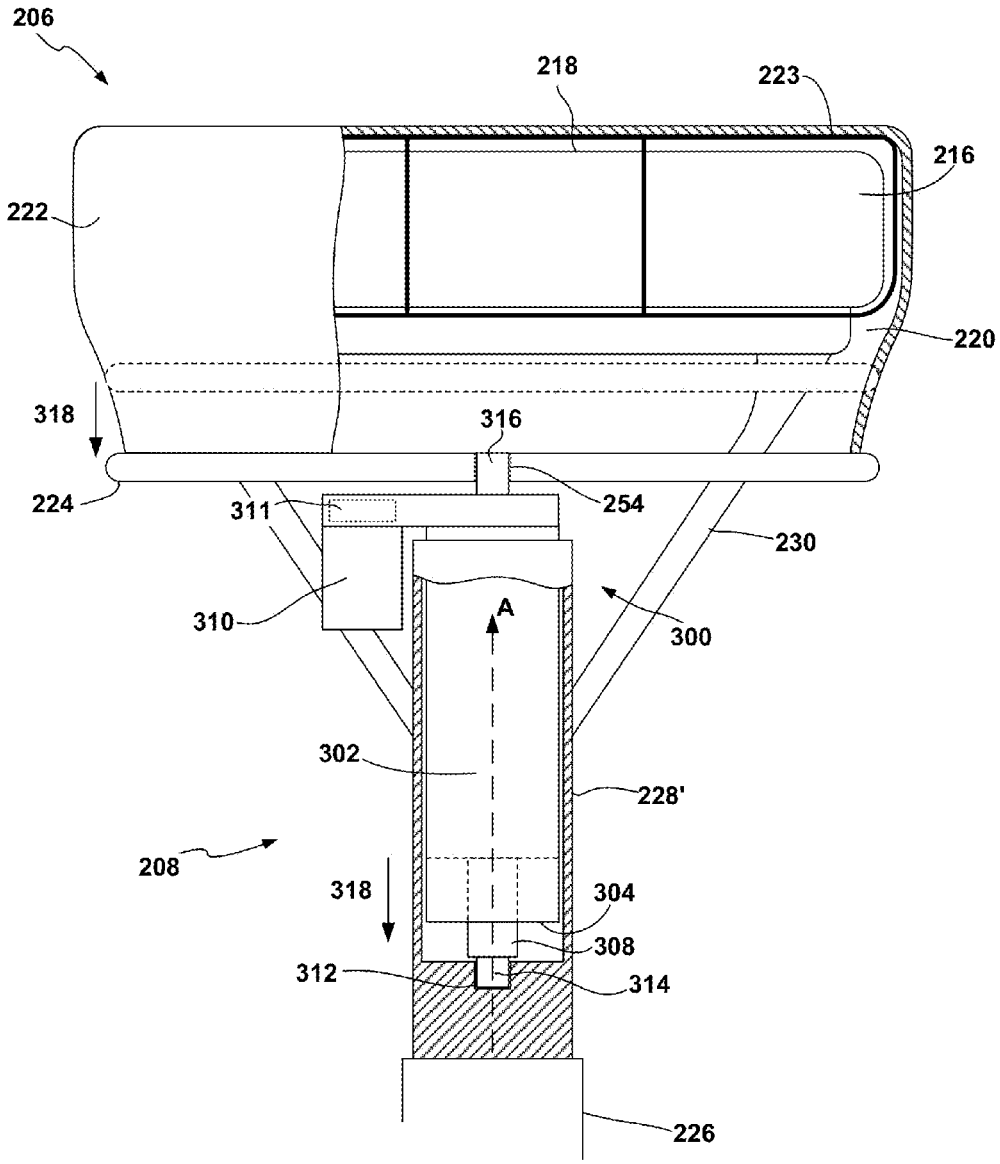
FIGS. 15A and 15B are side views, partly in section, of a portion of the compact electronic timpani assembly of FIG. 13 illustrating the hoop member moving between first and second positions.
Figure 15B:
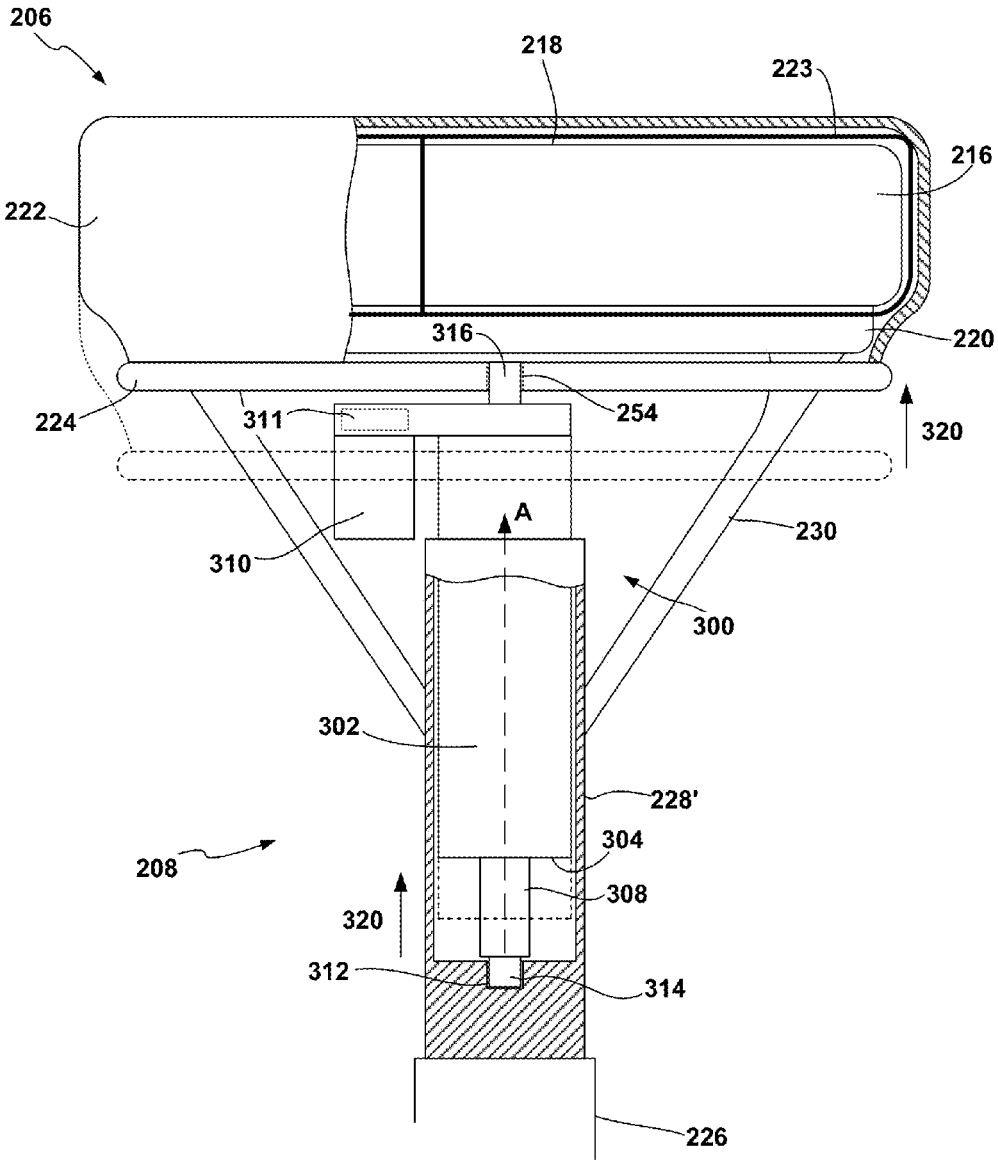

FIGS. 15A and 15B are side views, partly in section, of a portion of the electronic timpani assembly of FIG. 13 illustrating the hoop member 224 moving between first and second positions. As previously described, the tuning pedal 210*b* may be configured to communicate with and control operation of the linear actuator 300. In particular, the pitch identification module 280 may be configured to communicate with and transfer captured data related to the position of the foot platform 268 to the controller 311 of the linear actuator 300. The controller 311 may be configured to energize the adjustment mechanism, e.g. motor 310, based in response to the captured data and move the rod member 308 in an associated direction, and, in turn, adjust tension of the head 222 to correspond to the position of the foot platform 268

Referring to FIG. 15A, the hoop member 224 is illustrated moving from a first position to a second position. Generally, a higher pitch may be associated with an increase in tension of the head 222. As previously described, in the event a musician desires to raise the pitch, the toe portion 269 of the foot platform 268 may be depressed (shown in FIG. 14A). In turn, upon receiving data related to the position of the foot platform 268 (toe portion 269 depressed), the controller 311 may energize the motor 310, which in turn may move the rod member 308 in a linear direction towards the first end 304 of the housing 302, thereby drawing the rod member 308 within the housing 302.

In turn, the housing 302 is drawn in a direction towards the second support member 228', as indicated by arrow 318, due to the fact that the distal end 314 of the rod member 308 is coupled to the attachment member 312 of the second support member 228'. Additionally, the hoop member 224, coupled to the protrusion 316 of the housing 302, is also drawn in a direction towards the second support member 228', as indicated by arrow 318, and away from the pad member 216, wherein the hoop member 224 moves from a first position (indicated in phantom) to a second position. When the hoop member 224 is moved in a direction away from the striking surface 218 of the pad member 216, the tension of the head 222 increases and becomes more taught.

Referring to FIG. 15B, the hoop member 224 is illustrated moving from the second position to the first position. Generally, a lower pitch may be associated with a decrease in tension of the head 222. In the event a musician desires to lower the pitch, the heel portion 270 of the foot platform 268 may be depressed (shown in FIG. 14B). In turn, upon receiving data related to the position of the foot platform 268 (heel portion 270 depressed), the controller 311 may energize the motor 310, which in turn may move the rod member 308 in a linear direction away from the first end 304 of the housing 302. In turn, the housing 302 may move in a direction away from the second support member 228', as indicated by arrow 320, due to the fact that the distal end 314 of the rod member 308 is coupled to the attachment member 312 of the second support member 228'. Additionally, the hoop member 224, coupled to the protrusion 316 of the housing 302, may also move in a direction towards the second support member 228', as indicated by arrow 320, and towards the striking surface 218 of the pad member 216, wherein the hoop member 224 moves from the second position (indicated in phantom) to the first position. When the hoop member 224 is moved in a direction towards from the striking surface 218 of the pad member 216, the tension of the head 222 decreases.

It should be noted that the controller 311 may be configured to energize the motor 310 to move rod member 308 to various positions, and should not be limited to the first and second positions illustrated in FIGS. 15A and 15B.

Figure 16:
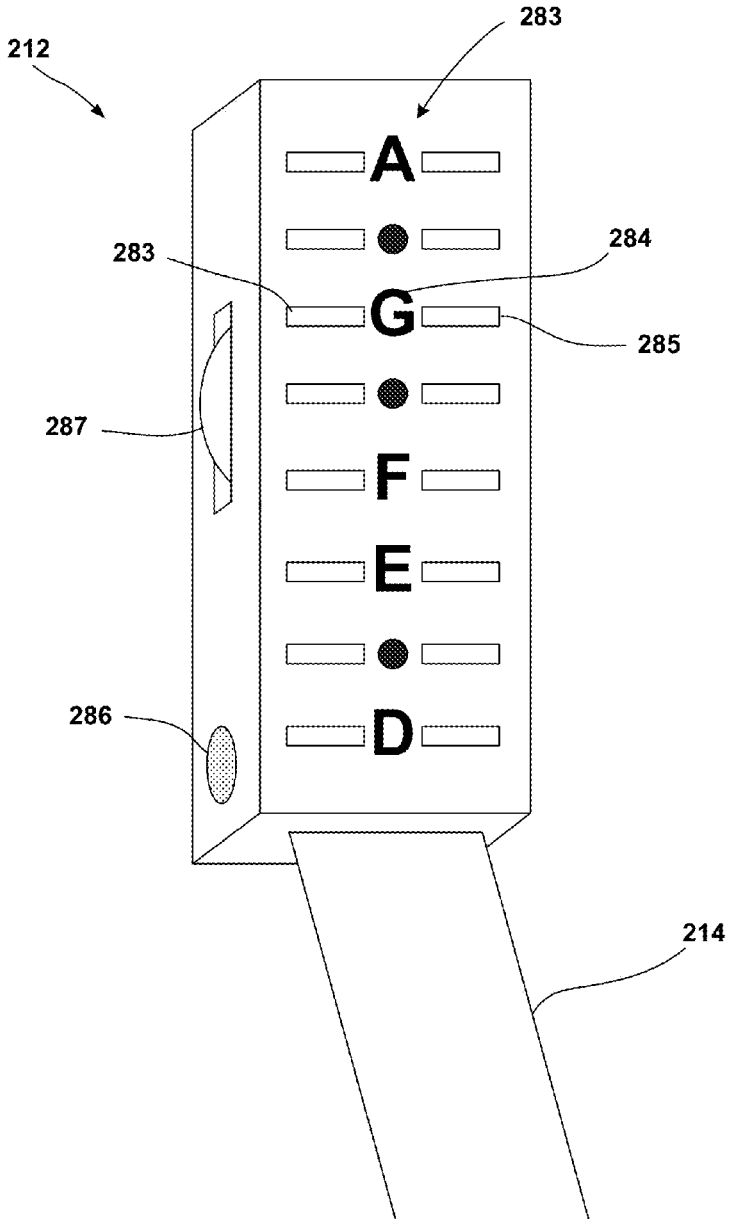
FIG. 16 is a perspective view of a tuning gauge of a compact electronic timpani assembly consistent with the present disclosure.

FIG. 16 is a perspective view of a tuning gauge 212 of an electronic timpani assembly consistent with the present disclosure. Generally, the tuning gauge 212 may include circuitry configured to communicate with the tuning pedal 210*a* of FIGS. 10A and 10B and the tuning pedal 210*b* of FIGS. 14A and 14B and provide a visual indication of the pitch to which the tuning pedal (210*a* or 210*b*) is set. In the illustrated embodiment, the tuning gauge 212 may include the musical range 283, including pitches 284, of the electronic timpani assembly 202 visually displayed on a surface of the tuning gauge 212. Each pitch 284 may include one or more associated markers 285 configured to visually indicate the pitch 284 to which the tuning pedal (210*a* or 210*b*) is set. Each marker may include, for example, an illumination source. The tuning gauge 212 may include circuitry configured to communicate with the tuning pedal (210*a* or 210*b*) and receive data related to the selected pitch. The circuitry may further be configured to activate the markers 285 of the selected pitch based on the data received from the tuning pedal (210*a* or 210*b*).

The tuning gauge 212 may further include one or more microphones/speakers 286 configured to allow a musician to confirm whether the electronic timpani is set to a desired pitch. More specifically, the microphone/speaker 286 may be configured to allow a musician to hum a desired pitch into the microphone/speaker 286. The tuning gauge 212 may include circuitry configured to receive and process the hummed pitch and determine whether the pitch of the electronic timpani matches the hummed pitch. In turn, the microphone/speaker 286 may be configured to provide auditory feedback to the musician indicating whether the hummed pitch and electronic timpani pitch match. The tuning gauge 212 may further include a fine-tuning adjustment mechanism 287 configured to allow a musician to manually fine-tune the pitch of the electronic timpani.

Figure 17:
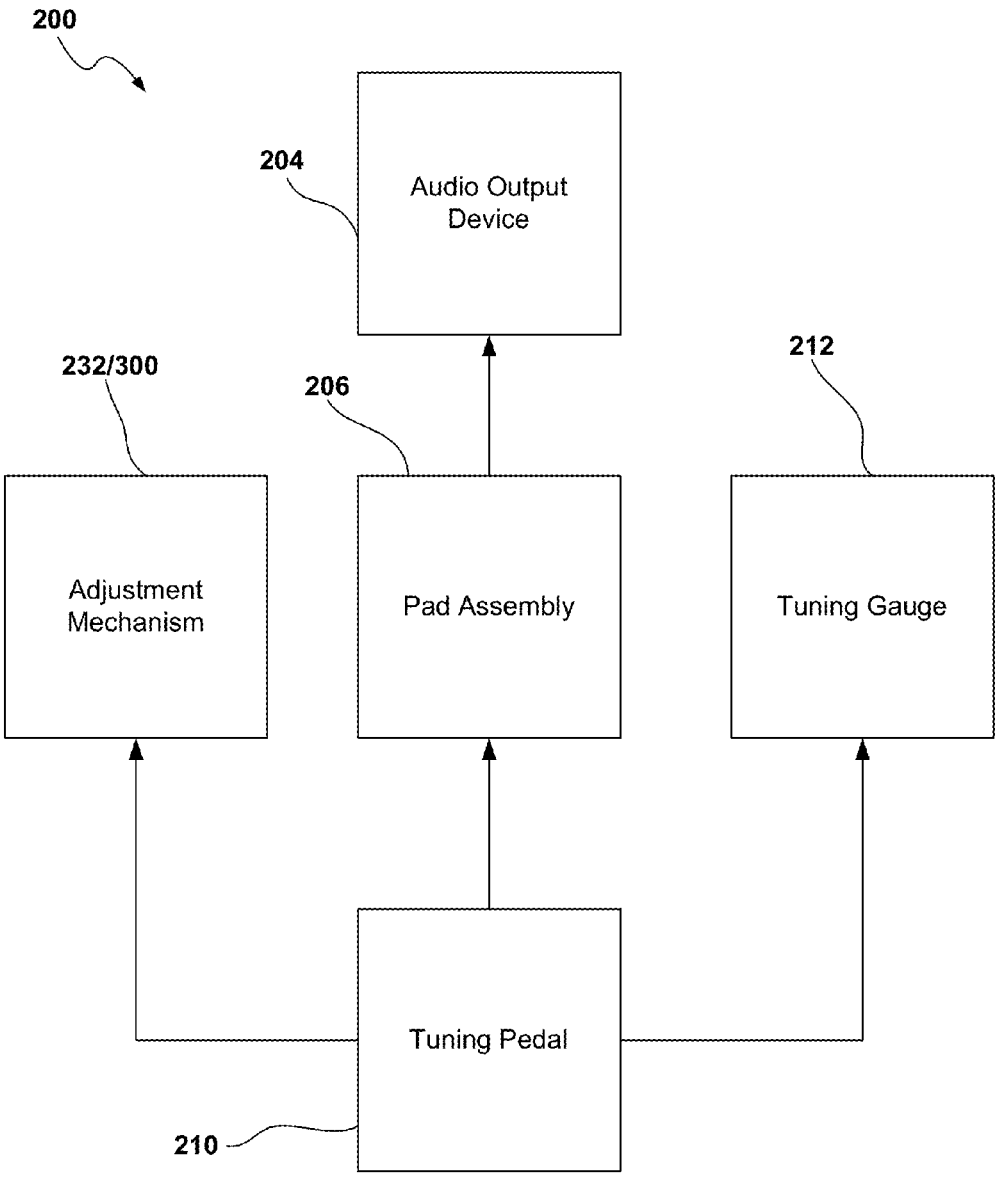
FIG. 17 is a block diagram of the system 200 of FIG. 2.

FIG. 17 is a block diagram of the system 200 of FIG. 2. Generally, the tuning pedal 210 may be configured to communicate with the adjustment mechanisms 232, 300, the pad assembly 206, and the tuning gauge 212 and the pad assembly 206 may be configured to communicate with the audio output device 204.

Figure 18A:
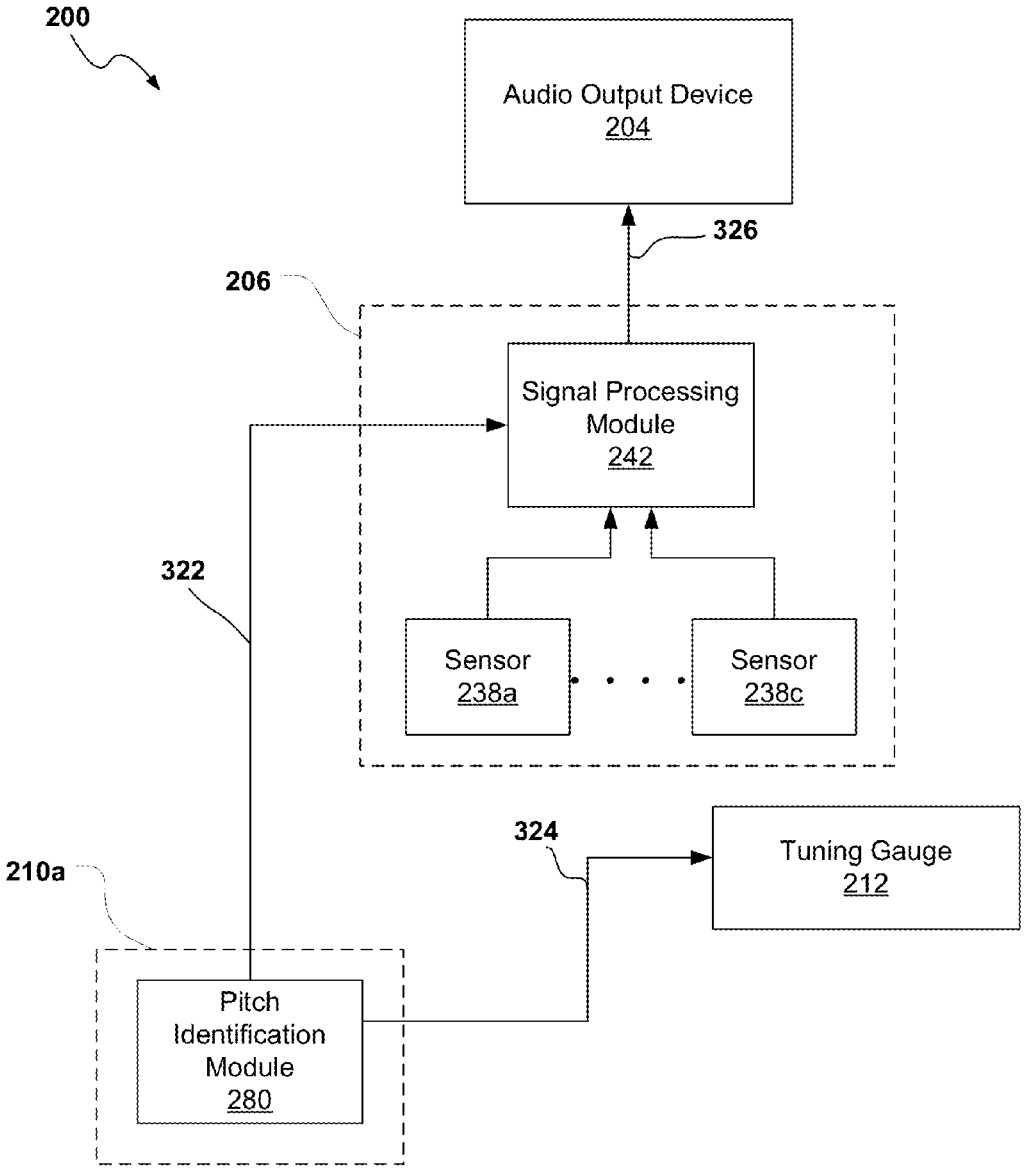
FIG. 18A is a block diagram illustrating the system of FIG. 17 including the adjustment mechanism 232 of FIGS. 4, 9 and 11B-11B and the tuning pedal 210*a* of FIGS. 10A-10B in greater detail.

FIG. 18A is a block diagram illustrating the system of FIG. 17 including the adjustment mechanism 232 of FIGS. 4, 9 and 11B-11B and the tuning pedal 210*a* of FIGS. 10A-10B in greater detail. As shown, the tuning pedal 210*a*, pad assembly 206, tuning gauge 212 and audio output device 204 may each include communication modules (not shown), wherein one or more of the communications modules may be configured to permit wireless communication between each of the components of the system 200. In particular, the pitch identification module 280 may be configured to wirelessly communicate with and transmit data related to an identified pitch to the signal processing module 242 of the pad assembly 206 and the tuning gauge 212 via communication links 322 and 324, respectively, via a wireless transmission protocol. Additionally, the signal processing module 242 may be configured to wireless communicate with and transmit sound signals to the audio output device 204 via communication link 326 via a wireless transmission protocol.

More specifically, the communication modules of the pitch identification module 280, pad assembly 206, tuning gauge 212, and/or audio output device 204 may be WiFi enabled, permitting wireless communication according to one of the 802.11 standards. Other wireless network protocols standards could also be used, either in alternative to the identified protocols or in addition to the identified protocol. Other network standards may include Bluetooth, an infrared transmission protocol, or wireless transmission protocols with other specifications. The advantages of wireless communication between components of the system 200 may provide a greater degree of flexibility and freedom for the musician. For example, a musician may wish to have the tuning pedal 210*a* in a particular location with respect to the pad assembly 206 and stand assembly 208. Conventional acoustic timpani have very little flexibility as far as placement of the components is concerned.

It should be noted that, in addition to wireless communication, the communication modules of each of the components (204, 206, 210*a*, 212) of the system 200 may include, for example, a wired-connection module, wherein one or more are configured to communicate with one another via a cable having a standard peripheral interface, such as, for example, RS-232C, PS/2, USB, etc.

Figure 18B:
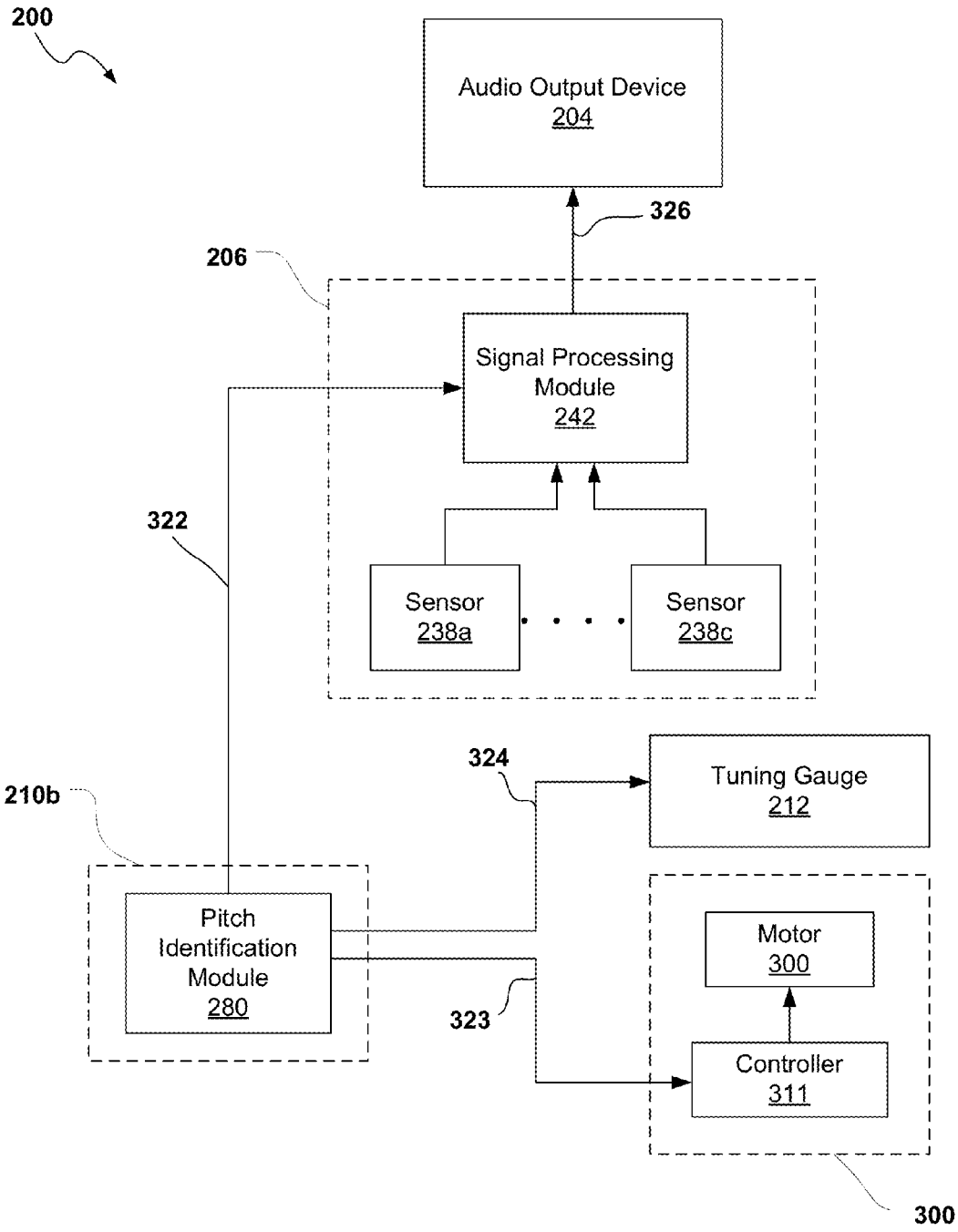
FIG. 18B is a block diagram illustrating the system of FIG. 17 including the adjustment mechanism 300 of FIGS. 12-13 and 15A-15B and the tuning pedal 210*b* of FIGS. 14A-14B in greater detail.

FIG. 18B is a block diagram illustrating the system of FIG. 17 including the adjustment mechanism 300 of FIGS. 12-13 and 15A-15B and the tuning pedal 210*b* of FIGS. 14A-14B in greater detail. As shown, the tuning pedal 210*b*, linear actuator 300, pad assembly 206, tuning gauge 212 and audio output device 204 may each include communication modules (not shown), wherein one or more of the communications modules may be configured to permit wireless communication between each of the components of the system 200. In particular, the tuning pedal 210*b* includes a pitch identification module 280 configured to wirelessly communicate with and transmit data related to the selected pitch to the signal processing module 242 of the pad assembly 206, the controller 311 of the linear actuator 300, and the tuning gauge 212 via communication links 322, 323 and 324, respectively, via a wireless transmission protocol. Additionally, the signal processing module 242 may be configured to wireless communicate with and transmit sound signals to the audio output device 204 via communication link 326 via a wireless transmission protocol.

It should be noted that, in addition to wireless communication, the communication modules of each of the components (204, 206, 210, 212, 300) of the system 200 may include, for example, a wired-connection module, wherein one or more are configured to communicate with one another via a cable having a standard peripheral interface, such as, for example, RS-232C, PS/2, USB, etc.

Consistent with one embodiment of the present disclosure, an electronic timpani assembly is provided. The electronic timpani assembly includes a pad assembly. The pad assembly includes a pad member having a striking surface configured to receive one or more strikes thereto. The pad member includes one or more sensors positioned on a portion thereof, wherein each sensor is configured to sense and capture data related to characteristics of a strike upon the striking surface. The pad assembly further includes a resilient head positioned over at least the striking surface of the pad member and a hoop member configured to retain the head over at least the striking surface of the pad member.

The electronic timpani assembly further includes at least one signal processing module configured to receive captured data from at least one of the sensors and produce a sound signal related to a musical tone associated with the captured data. The electronic timpani assembly further includes a stand assembly including at least one support member configured to provide support to the pad assembly. The electronic timpani assembly further includes an adjustment mechanism extending from a portion of the at least one support member. The adjustment mechanism is coupled to a portion of the hoop member and configured to move the hoop member from a first position to a second position relative to the pad member and adjust tension of the head.

The electronic timpani assembly further includes a tuning pedal configured to control operation of the adjustment mechanism to move the hoop member relative to the pad member to adjust tension of the head. The electronic timpani assembly further includes a pitch identification module responsive to adjustment of tension of the head and configured to identify a pitch corresponding to tension of the head. The pitch identification module is configured to transmit a signal related to the identified pitch to the at least one signal processing module to adjust pitch of the musical tone to reflect the identified pitch.

Consistent with another embodiment of the present disclosure, a system includes at least one electronic timpani assembly and an audio output device configured to reproduce sound signals received from the at least one electronic timpani assembly into audio content. The electronic timpani assembly includes a pad assembly. The pad assembly includes a pad member having a striking surface configured to receive one or more strikes thereto. The pad member includes one or more sensors positioned on a portion thereof, wherein each sensor is configured to sense and capture data related to characteristics of a strike upon the striking surface. The pad assembly further includes a resilient head positioned over at least the striking surface of the pad member and a hoop member configured to retain the head over at least the striking surface of the pad member.

The electronic timpani assembly further includes at least one signal processing module configured to receive captured data from at least one of the sensors and produce a sound signal related to a musical tone associated with the captured data. The electronic timpani assembly further includes a stand assembly including at least one support member configured to provide support to the pad assembly. The electronic timpani assembly further includes an adjustment mechanism extending from a portion of the at least one support member. The adjustment mechanism is coupled to a portion of the hoop member and configured to move the hoop member from a first position to a second position relative to the pad member and adjust tension of the head.

The electronic timpani assembly further includes a tuning pedal configured to control operation of the adjustment mechanism to move the hoop member relative to the pad member to adjust tension of the head. The electronic timpani assembly further includes a pitch identification module responsive to adjustment of tension of the head and configured to identify a pitch corresponding to tension of the head. The pitch identification module is configured to transmit a signal related to the identified pitch to the at least one signal processing module to adjust pitch of the musical tone to reflect the identified pitch.

Consistent with another embodiment of the present disclosure, an electronic timpani assembly is provided. The electronic timpani assembly includes a pad assembly. The pad assembly includes a pad member having a striking surface configured to receive one or more strikes thereto. The pad member includes one or more sensors positioned on a portion thereof, wherein each sensor is configured to sense and capture data related to characteristics of a strike upon the striking surface. The pad assembly further includes a resilient head positioned over at least the striking surface of the pad member and a hoop member configured to retain the head over at least the striking surface of the pad member.

The electronic timpani assembly further includes a stand assembly including at least one support member configured to provide support to the pad assembly. The electronic timpani assembly further includes an adjustment mechanism extending from a portion of the at least one support member. The adjustment mechanism is coupled to a portion of the hoop member and configured to move the hoop member from a first position to a second position relative to the pad member and adjust tension of the head. The electronic timpani assembly further includes a tuning pedal configured to control operation of the adjustment mechanism to move the hoop member relative to the pad member to adjust tension of the head.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

As used in any embodiment herein, the term "module" refers to software, firmware and/or circuitry configured to perform the stated operations. The software may be embodied as a software package, code and/or instruction set or instructions, and "circuitry", as used in any embodiment herein, may comprise, for example, singly or in any combination, hardwired circuitry, programmable circuitry, state machine circuitry, and/or firmware that stores instructions executed by programmable circuitry. The modules may, collectively or individually, be embodied as circuitry that forms part of a larger system, for example, an integrated circuit (IC), system on-chip (SoC), etc.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present invention should not be limited by any of the above-described exemplary embodiments, but should be defined only in accordance with the following claims and their equivalents.

What is claimed is:

1. An electronic timpani assembly comprising:

a pad assembly comprising:

a pad member having a striking surface configured to receive one or more strikes thereto;

one or more sensors positioned on a portion of said pad member, each sensor being configured to sense and capture data related to characteristics of a strike upon said striking surface;

a resilient head positioned over at least said striking surface of said pad member; and a hoop member configured to retain said head over at least said striking surface of said pad member;

at least one signal processing module configured to receive captured data from at least one of said sensors and produce a sound signal related to a musical tone associated with said captured data;

a stand assembly comprising at least one support member configured to provide support to said pad assembly;

an adjustment mechanism extending from a portion of said at least one support member, said adjustment mechanism being coupled to a portion of said hoop member and configured to move said hoop member from a first position to a second position relative to said pad member and adjust tension of said head; and a tuning pedal configured to control operation of said adjustment mechanism to move said hoop member relative to said pad member to adjust tension of said head; and a pitch identification module responsive to adjustment of tension of said head and configured to identify a pitch corresponding to tension of said head and to transmit a signal related to said identified pitch to said at least one signal processing module to adjust pitch of said musical tone to reflect said identified pitch.

2. The electronic timpani assembly of claim 1, further comprising a tuning gauge configured to communicate with said pitch identification module and visually indicate said identified pitch.

3. The electronic timpani assembly of claim 2, wherein said pitch identification module may be configured to wirelessly communicate with at least one of said at least one signal processing module, said adjustment mechanism and said tuning gauge.

4. The electronic timpani assembly of claim 1, wherein said at least one signal processing module comprises a database of audio files, each musical tone related to one of said audio files.

5. The electronic timpani assembly of claim 1, wherein said head comprises a material capable of elastically conforming to a portion of a frame positioned over said pad member when said head is positioned over said pad member.

6. The electronic timpani assembly of claim 1, wherein each sensor is configured to capture and determine data related to at least one of strength of impact of said strike, velocity of impact of said strike, location of impact of said strike, and hardness of a striking instrument.

7. The electronic timpani assembly of claim 1, wherein said striking surface of said pad member has an area approximately 20% of an area of a playing surface of a head of an associated acoustic timpani.

8. The electronic timpani assembly of claim 1, wherein said pad member comprises first, second and third striking zones, wherein each of said first, second and third striking zones comprises at least one corresponding sensor positioned within.

9. The electronic timpani assembly of claim 1, wherein said adjustment mechanism comprises a Bowden cable.

10. The electronic timpani assembly of claim 1, wherein said adjustment mechanism comprises a linear actuator.

11. A system comprising:

at least one electronic timpani assembly, said at least one timpani assembly comprising:

a pad assembly comprising:

a pad member having a striking surface configured to receive one or more strikes thereto;

one or more sensors positioned on a portion of said pad member, each sensor being configured to sense and capture data related to characteristics of a strike upon said striking surface;

a resilient head positioned over at least said striking surface of said pad member; and a hoop member configured to retain said head over at least said striking surface of said pad member;

at least one signal processing module configured to receive captured data from at least one of said sensors and produce a sound signal related to a musical tone associated with said captured data;

a stand assembly comprising at least one support member configured to provide support to said pad assembly;

an adjustment mechanism extending from a portion of said at least one support member, said adjustment mechanism being coupled to a portion of said hoop member and configured to move said hoop member from a first position to a second position relative to said pad member and adjust tension of said head; and a tuning pedal configured to control operation of said adjustment mechanism to move said hoop member relative to said pad member to adjust tension of said head; and a pitch identification module responsive to adjustment of tension of said head and configured to identify a pitch corresponding to tension of said head and to transmit a signal related to said identified pitch to said at least one signal processing module to adjust pitch of said musical tone to reflect said identified pitch; and an audio output device configured to reproduce sound signals received from said at least one signal processing module of said at least one electronic timpani assembly into audio content.

12. The system of claim 11, further comprising a tuning gauge configured to communicate with said pitch identification module visually indicate said identified pitch.

13. The system of claim 12, wherein said pitch identification module may be configured to wirelessly communicate with at least one of said at least one signal processing module, said adjustment mechanism and said tuning gauge.

14. The system of claim 11, wherein said audio output device is configured to wirelessly communicate with said at least one signal processing module.

15. The system of claim 11, wherein said at least one signal processing module comprises a database of audio files, each musical tone related to one of said audio files.

16. The system of claim 11, wherein each sensor is configured to capture and determine data related to at least one of strength of impact of said strike, velocity of impact of said strike, location of impact of said strike, and hardness of a striking instrument.

17. The system of claim 11, wherein said striking surface of said pad member has an area approximately 20% of an area of a playing surface of a head of an associated acoustic timpani.

18. The system of claim 11, wherein said adjustment mechanism comprises a Bowden cable.

19. The system of claim 11, wherein said adjustment mechanism comprises a linear actuator.

20. An electronic timpani assembly comprising:

a pad assembly comprising:

a pad member having a striking surface configured to receive one or more strikes thereto;

one or more sensors positioned on a portion of said pad member, each sensor being configured to sense and capture data related to characteristics of a strike upon said striking surface;

a resilient head positioned over at least said striking surface of said pad member; and a hoop member configured to retain said head over at least said striking surface of said pad member;

a stand assembly comprising at least one support member configured to provide support to said pad assembly;

an adjustment mechanism extending from a portion of said at least one support member, said adjustment mechanism being coupled to a portion of said hoop member and configured to move said hoop member from a first position to a second position relative to said pad member and adjust tension of said head; and a tuning pedal configured to control operation of said adjustment mechanism to move said hoop member relative to said pad member to adjust tension of said head.

* * * * *